US007814723B2

(12) United States Patent
VanElverdinghe

(10) Patent No.: US 7,814,723 B2
(45) Date of Patent: Oct. 19, 2010

(54) BEAM AND TRUSS STRUCTURE FOR A CANOPY

(76) Inventor: Jeffry L. VanElverdinghe, 4537 SW. 164th Pl., Beaverton, OR (US) 97007

( * ) Notice: Subject to any disclaimer, the term of this patent is extended or adjusted under 35 U.S.C. 154(b) by 309 days.

(21) Appl. No.: 11/861,228

(22) Filed: Sep. 25, 2007

(65) Prior Publication Data

US 2008/0072946 A1 Mar. 27, 2008

Related U.S. Application Data

(60) Provisional application No. 60/827,047, filed on Sep. 26, 2006, provisional application No. 60/826,904, filed on Sep. 25, 2006.

(51) Int. Cl.
*E04B 7/08* (2006.01)
*E04C 3/02* (2006.01)
*E04H 15/44* (2006.01)

(52) U.S. Cl. ..... 52/641; 52/646; 52/695; 52/655.1; 135/122

(58) Field of Classification Search ..... 52/63, 52/222, 695, 657, 653.1, 655.1, 633, 641, 52/506.8, 506.1, 848; 135/121, 122
See application file for complete search history.

(56) References Cited

U.S. PATENT DOCUMENTS

| | | | |
|---|---|---|---|
| D30,268 | S | 2/1899 | Wittbold |
| 3,976,014 | A | 8/1976 | Brown |
| 3,999,875 | A | 12/1976 | Simon |
| 4,124,123 | A | 11/1978 | Armington et al. |
| 4,285,176 | A | 8/1981 | Runkle |
| 4,288,949 | A | 9/1981 | Latimer |
| 4,347,690 | A | 9/1982 | Wallace, Jr. |
| 4,381,629 | A | 5/1983 | Ahn |
| 4,389,133 | A | 6/1983 | Oberst |
| 4,453,558 | A | 6/1984 | Ochs et al. |
| 4,464,074 | A | 8/1984 | Green et al. |
| 4,502,257 | A | 3/1985 | Diamond |
| 4,605,030 | A | 8/1986 | Johnson |
| 4,633,626 | A | 1/1987 | Freeman et al. |

(Continued)

OTHER PUBLICATIONS

PCT/US07/79463 International Search Report and Written Opinion, 14 pages, Apr. 16, 2008.

(Continued)

*Primary Examiner*—David Dunn
*Assistant Examiner*—Danielle Jackson
(74) *Attorney, Agent, or Firm*—Joseph P. Curtin, L.L.C.

(57) ABSTRACT

A structure comprises a ridge beam, a plurality of truss beams, and a plurality of legs. The ridge beam comprises a first end and a second end. Each end comprises at least one tab member that projects in a direction that is substantially parallel to a plane of the ridge beam. Each truss beam comprises first and second ends that each comprises a plurality of apertures and at least one tab member that projects in a direction that is substantially parallel to a plane of the truss beam. Tab members of two truss beams are respectively capable of engaging a corresponding aperture of the other truss beam to form a peak section. At least one aperture of each of the two truss beams is capable of being aligned receiving a corresponding tab member of the ridge beam. Each respective leg engages the second end of a corresponding truss beam.

18 Claims, 30 Drawing Sheets

U.S. PATENT DOCUMENTS

| | | | | |
|---|---|---|---|---|
| D297,864 | S | | 9/1988 | Funk |
| 4,802,501 | A | | 2/1989 | Hall, II |
| D302,593 | S | | 8/1989 | Haldorsen |
| 4,852,599 | A | | 8/1989 | McNamara |
| 4,865,066 | A | | 9/1989 | Brooks |
| 4,918,899 | A | | 4/1990 | Karytinos |
| 4,951,438 | A | | 8/1990 | Thoresen |
| 5,009,184 | A | | 4/1991 | Voldrich |
| 5,117,853 | A | | 6/1992 | Pruesner |
| 5,167,246 | A | | 12/1992 | Mortenson |
| 5,185,972 | A | | 2/1993 | Markiewicz |
| 5,241,977 | A | | 9/1993 | Flores et al. |
| 5,259,821 | A | * | 11/1993 | Bryant ..... 474/136 |
| D343,688 | S | | 1/1994 | Jason |
| 5,279,085 | A | | 1/1994 | DiPaolo et al. |
| 5,289,665 | A | | 3/1994 | Higgins |
| 5,293,725 | A | | 3/1994 | Matticks et al. |
| 5,331,992 | A | | 7/1994 | Gremont |
| D374,088 | S | | 9/1996 | Collier |
| 5,573,026 | A | | 11/1996 | Griffith |
| 5,584,156 | A | | 12/1996 | Lange |
| 5,584,311 | A | | 12/1996 | Schaefer |
| 5,588,274 | A | | 12/1996 | Lange |
| 5,598,668 | A | | 2/1997 | Isom |
| 5,634,483 | A | | 6/1997 | Gwin |
| 5,638,848 | A | | 6/1997 | November |
| 5,638,851 | A | | 6/1997 | Baldwin |
| 5,660,002 | A | | 8/1997 | Lashinger |
| 5,671,580 | A | | 9/1997 | Chou |
| 5,711,337 | A | | 1/1998 | McKenney |
| 5,737,883 | A | | 4/1998 | Rose |
| 5,746,237 | A | | 5/1998 | Arnic |
| 5,802,772 | A | | 9/1998 | Burke et al. |
| 5,813,737 | A | | 9/1998 | Stone |
| 5,857,306 | A | | 1/1999 | Pellock |
| 5,862,826 | A | | 1/1999 | Gremont |
| D409,310 | S | | 5/1999 | Goldwitz |
| 5,921,049 | A | | 7/1999 | Sugiyama |
| D414,564 | S | | 9/1999 | Goldwitz |
| D415,572 | S | | 10/1999 | Goldwitz |
| 5,996,666 | A | | 12/1999 | Denina |
| D420,751 | S | | 2/2000 | Powell et al. |
| 6,032,431 | A | | 3/2000 | Sugiyama |
| 6,044,593 | A | | 4/2000 | Puls |
| D430,306 | S | | 8/2000 | Goldwitz |
| 6,112,756 | A | | 9/2000 | Tseng |
| 6,155,280 | A | | 12/2000 | Powell et al. |
| 6,170,503 | B1 | | 1/2001 | Lin Shy |
| 6,196,245 | B1 | | 3/2001 | Eastman |
| 6,289,909 | B1 | | 9/2001 | Wood |
| 6,309,132 | B1 | | 10/2001 | Jakob et al. |
| 6,345,638 | B1 | | 2/2002 | Warner |
| 6,360,492 | B1 | | 3/2002 | Ross |
| 6,367,495 | B1 | | 4/2002 | Powell et al. |
| 6,367,496 | B1 | | 4/2002 | Rempel et al. |
| 6,502,593 | B1 | | 1/2003 | Stafford |
| 6,505,638 | B1 | | 1/2003 | Powell et al. |
| 6,581,616 | B1 | | 6/2003 | Venegas, Jr. |
| D478,998 | S | | 8/2003 | Funk |
| 6,615,550 | B2 | | 9/2003 | Reuschel et al. |
| 6,679,009 | B2 | | 1/2004 | Hotes |
| 6,722,809 | B2 | | 4/2004 | Hamberger et al. |
| 6,758,230 | B2 | | 7/2004 | Bogart, Jr. |
| 6,763,842 | B2 | | 7/2004 | Blount |
| 6,766,623 | B1 | | 7/2004 | Kalnay |
| 6,874,518 | B2 | | 4/2005 | Porter |
| 6,988,505 | B2 | | 1/2006 | Powell et al. |
| 6,994,099 | B2 | | 2/2006 | Goldwitz |
| 7,025,074 | B2 | | 4/2006 | Porter |
| 7,152,614 | B2 | | 12/2006 | Kalnay |
| 7,275,555 | B2 | | 10/2007 | Powell et al. |
| 7,296,584 | B2 | | 11/2007 | Goldwitz |
| 2001/0052356 | A1 | | 12/2001 | Ross |
| 2002/0043030 | A1 | | 4/2002 | Bogart, Jr. |
| 2002/0108646 | A1 | | 8/2002 | Hotes |
| 2002/0153033 | A1 | | 10/2002 | Miller |
| 2003/0005953 | A1 | | 1/2003 | Erbetta et al. |
| 2004/0035454 | A1 | | 2/2004 | Tseng |
| 2004/0040590 | A1 | | 3/2004 | Powell et al. |
| 2004/0118054 | A1 | | 6/2004 | Thompson |
| 2004/0118443 | A1 | | 6/2004 | Powell et al. |
| 2005/0194028 | A1 | | 9/2005 | Shinner et al. |
| 2005/0194029 | A1 | | 9/2005 | Goldwitz |
| 2005/0194031 | A1 | | 9/2005 | Goldwitz |
| 2005/0224105 | A1 | | 10/2005 | Yang |
| 2006/0102220 | A1 | | 5/2006 | Gat |
| 2006/0130887 | A1 | | 6/2006 | Mallookis et al. |
| 2006/0231128 | A1 | | 10/2006 | Loudermilk et al. |
| 2008/0017231 | A1 | | 1/2008 | Chen |
| 2008/0035194 | A1 | | 2/2008 | Goldwitz |

OTHER PUBLICATIONS

PCT/US2007/079463 International Preliminary Report on Patentability, Apr. 9, 2009, 13 pages.

B. Babich et al., "Truss Bracing, Design Guidelines for Bracing of Cold-formed Steel Trusses," Structure Magazine, Apr. 2004, pp. 26-29.

Assembly Instructions & Parts Manual #2070798, Q Line Industrial Shelving, Closed Style Installation Instructions, Tennsco Corp., 8 pages, downloaded Dec. 31, 2006.

Assembly Instructions & Parts Manual #2060699, Q Line Industrial Shelving, Open Style Installation Instructions, Tennsco Corp., 8 pages, downloaded Dec. 31, 2006.

Assembly Instructions & Parts Manual #1540703, Home Shelving System, Model No. LSS-361872, Tennsco Corp., 4 pages, downloaded Dec. 31, 2006.

Assembly Instructions & Parts Manual #1090703, Home Shelving System, Model No. LSS-482484, Tennsco Corp., 4 pages, downloaded Dec. 31, 2006.

Assembly Instructions & Parts Manual #1971199, Z-Line Standard Boltless Rack Installation Instructions, Tennsco Corp., 4 pages, downloaded Dec. 31, 2006.

Stur-D-Stor Industrial Strength Storage Shelves, Tennsco Corp., 1 page, downloaded Dec. 31, 2006.

* cited by examiner

BEAM AND TRUSS STRUCTURE FOR A CANOPY

CROSS-REFERENCE TO RELATED APPLICATIONS

The present utility patent application claims priority to U.S. Provisional Patent Application Ser. No. 60/827,047, filed Sep. 26, 2006, entitled "Beam and Truss Structure For A Canopy," invented by Jeffry L. VanElverdinghe, which is a continuation-in-part provisional patent application that claims priority to U.S. Provisional Patent Application Ser. No. 60/826,904, filed Sep. 25, 2006, entitled "Beam and Truss Structure For A Canopy," invented by Jeffry L. VanElverdinghe, the disclosure of both being incorporated by reference herein.

BACKGROUND

Several types of canopy structures are known. For example, U.S. Pat. Nos. 6,155,280 to Powell et al., 6,367,495 B1 to Powell et al., and 6,505,638 B1 to Powell et al. disclose known canopy structures.

BRIEF DESCRIPTION OF THE DRAWINGS

The subject matter disclosed herein is illustrated by way of example and not by limitation in the accompanying figures in which like reference numerals indicate similar elements and in which:

FIGS. 2Z-2AB respectively show different views of an exemplary embodiment of an lower leg beam member according to the subject matter disclosed herein;

FIG. 2AC shows an exemplary embodiment of a lower leg beam member assembled with an exemplary embodiment of a lower leg member at a corner of a structure according to the subject matter disclosed herein;

FIG. 2AD shows an exemplary embodiment of a lower leg beam member assembled with an exemplary embodiment of a lower leg member and an exemplary embodiment of a lower leg beam member at a junction of two sections of a structure according to the subject matter disclosed herein;

DETAILED DESCRIPTION

Figure 1A:
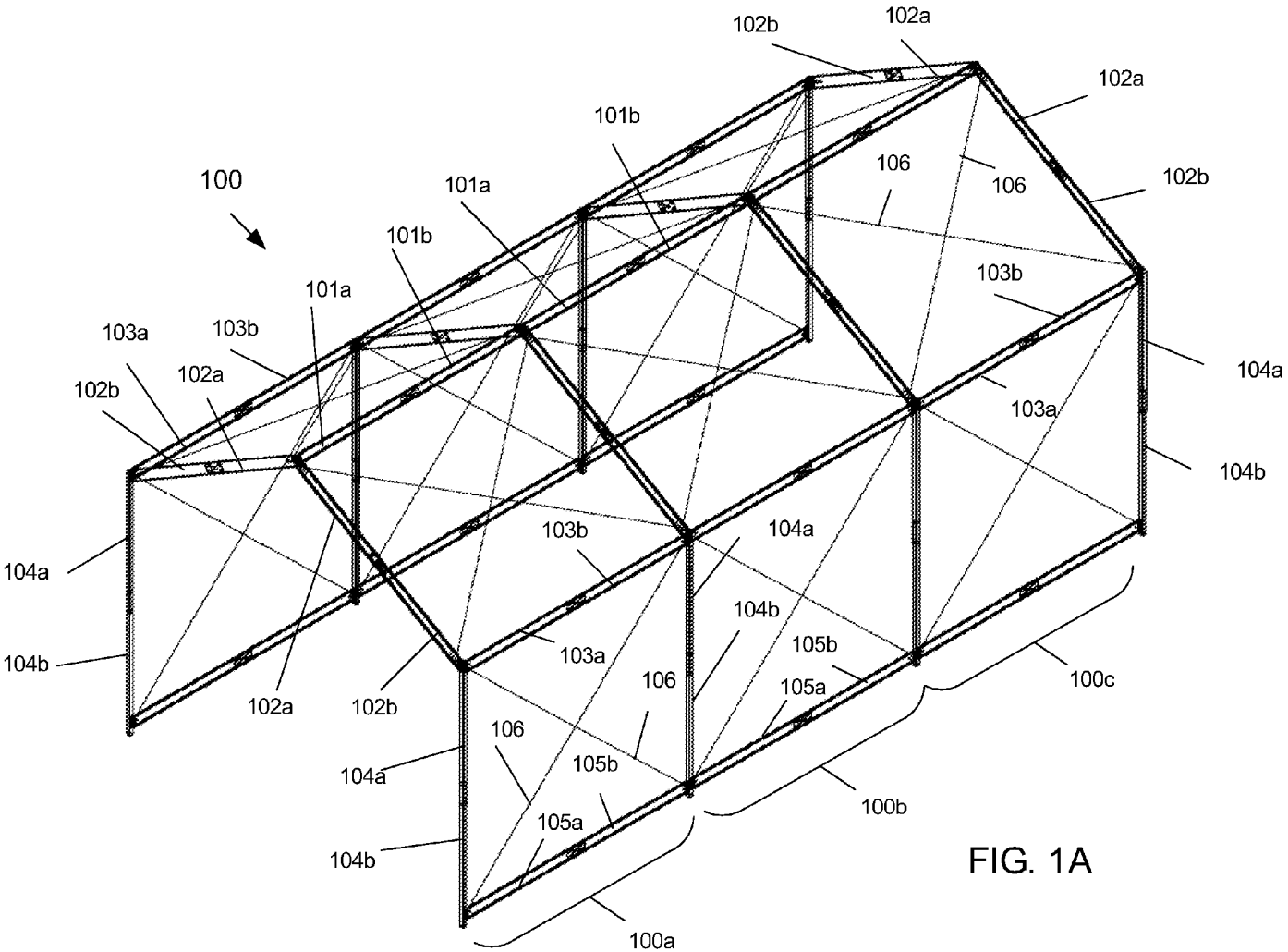
FIGS. 1A-1D respectively show an isometric view, a top view, a front view and a side view of a first exemplary embodiment of a beam and truss structure for a canopy according to the subject matter disclosed herein.
Figure 1B:
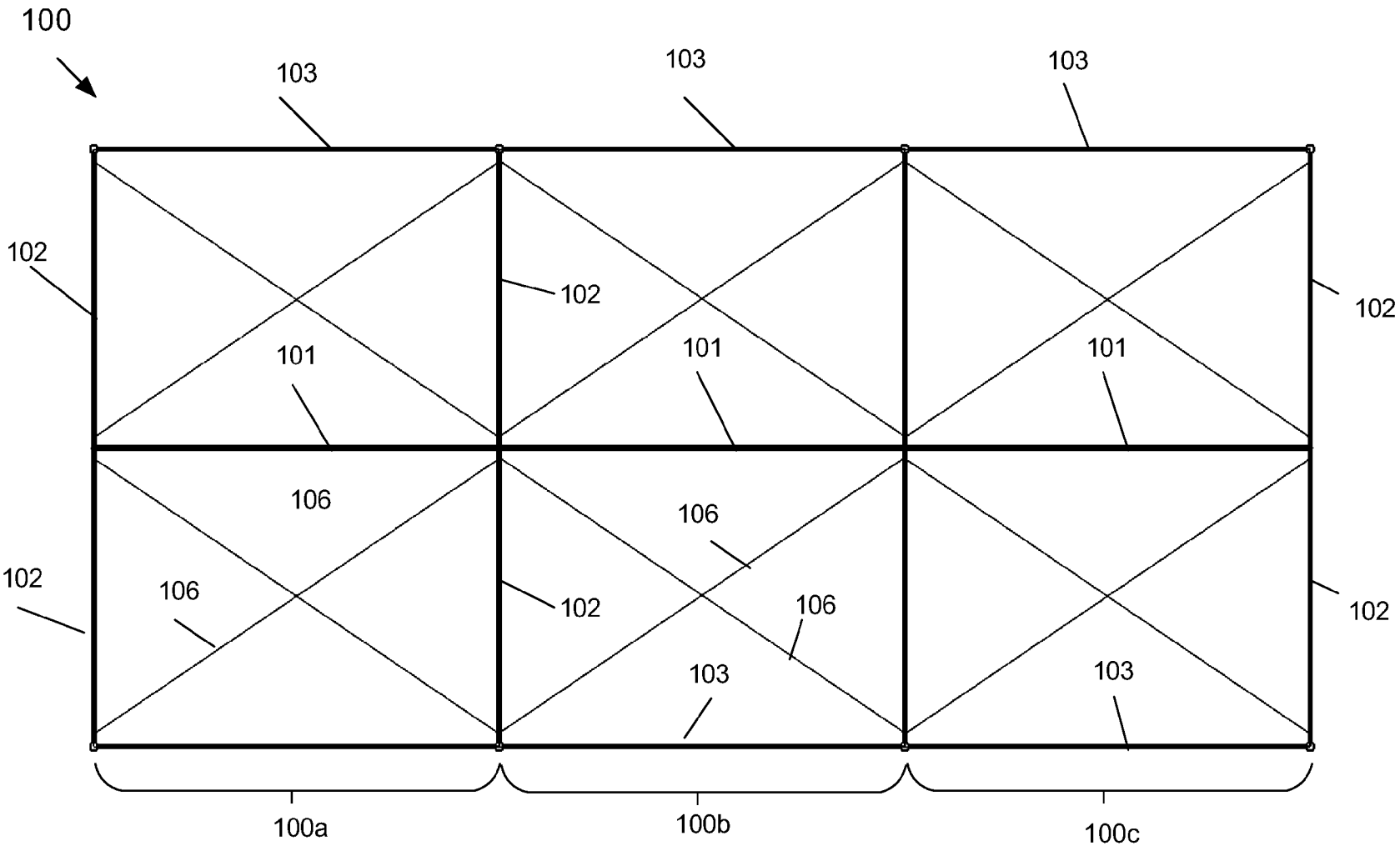
Figure 1C:
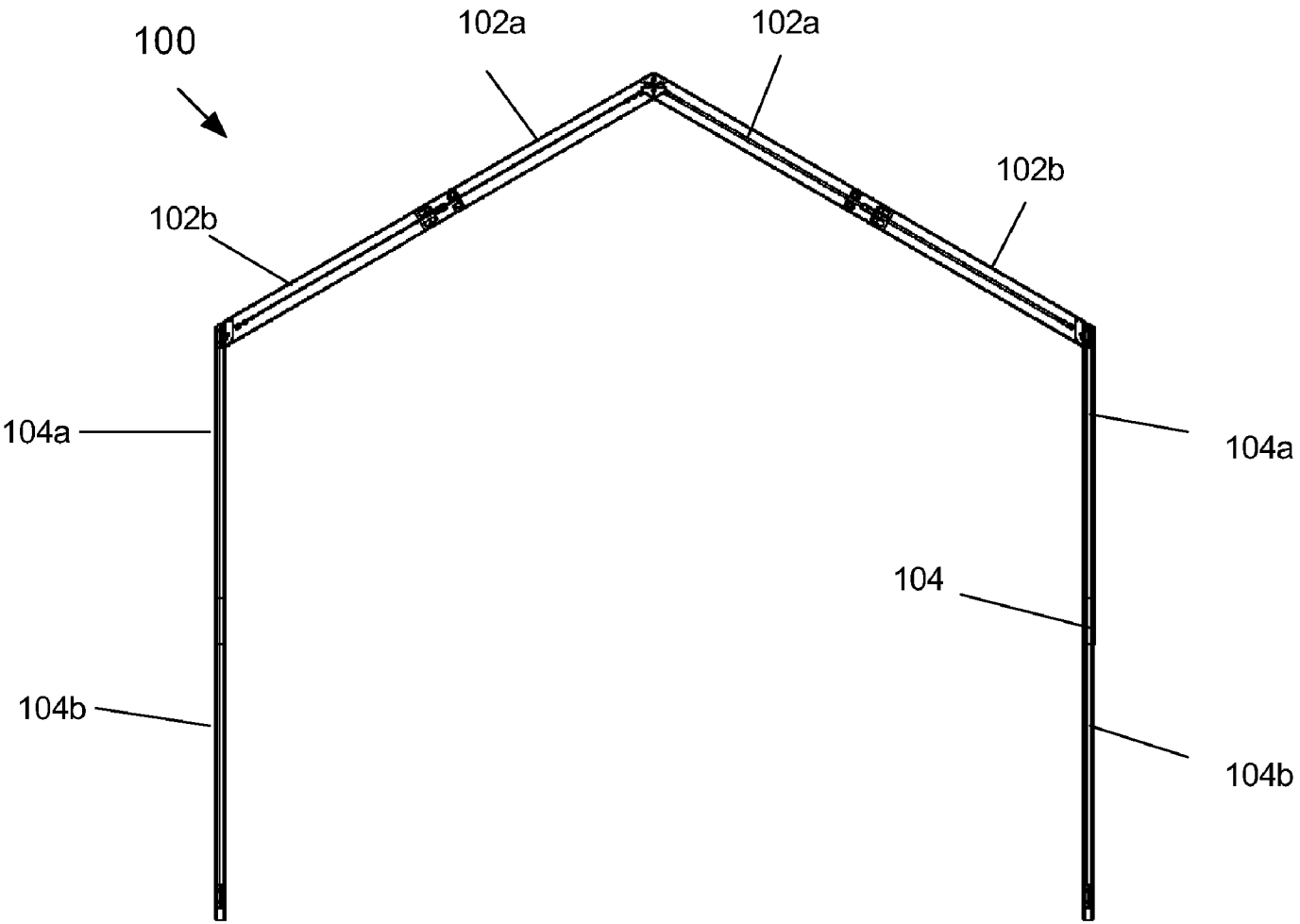
Figure 1D:
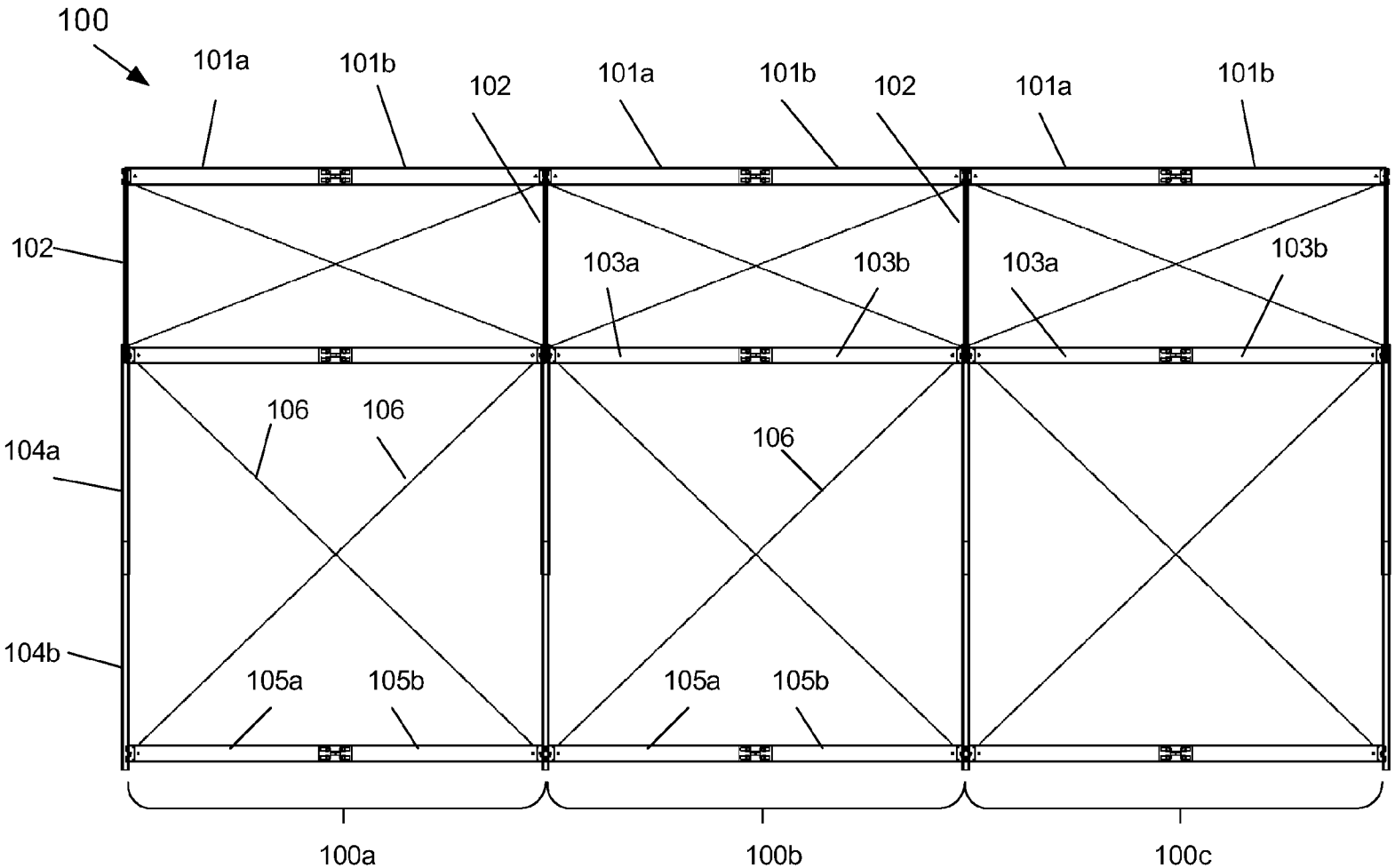

As used herein, the word "exemplary" is used to mean "serving as an example, instance, or illustration." Any embodiment described herein as "exemplary" is not necessarily to be construed as preferred or advantageous over other embodiments.

FIGS. 1A-1D respectively show an isometric view, a top view, a front view and a side view of an exemplary embodiment of a beam and truss structure 100 for a canopy according to the subject matter disclosed herein. Beam and truss structure 100 comprises a plurality of ridge beams 101, a plurality of truss beams 102, a plurality of upper leg beams 103, a plurality of legs 104, a plurality of lower leg beams 105, and a plurality of bracing mechanisms 106, of which only a few of each component are indicated by reference numerals for clarity in FIGS. 1A-1D. For exemplary embodiment 100: each ridge beam 101 comprises two ridge beam members, indicated by reference numerals 101*a* and 101*b*; each truss beam 102 comprises an upper truss beam member 102*a* and a lower truss beam member 102*b*; each upper leg beam 103 comprises two upper leg beam members, indicated by reference numerals 103*a* and 103*b*; each leg 104 comprises an upper leg member 104*a* and a lower leg member 104*b*; and each lower leg beam 105 comprises two lower leg beam members indicated by reference numerals 105*a* and 105*b*. The various components fit together as described below. It should be understood that other exemplary embodiments of a beam and truss structure according to the subject matter disclosed herein could comprise beams and/or truss beams formed from one or more members.

As shown in FIGS. 1A-1D, the exemplary embodiment of structure 100 comprises a ridge beam 101 at the apex of structure 100 that spans between two pairs of truss beams 102 at the upper end of truss beams 102. Two upper leg beams 103 span between the two truss beams 102 at the lower end of truss beams 102. A leg 104 extends downward from the junction of a truss beam 102 and an upper leg beam 103. A lower leg beam 105 extends between two legs 104 in parallel to an upper leg beam. In one exemplary embodiment, a lower leg beam extends between two legs 104 near the bottom of the two leg beams 104. In another exemplary embodiment, a lower leg beam extends between two legs 104 at a selected height above the bottom of legs 104. Accordingly, one free-standing section, indicated by, for example, reference numeral 100*a*, comprises one ridge beam 101, four truss beams 102, two upper leg beams 103, four legs 104 and two lower leg beams 105. According to the subject matter disclosed herein, an additional section, indicated by reference numeral 100*b*, could be added to a free-standing section and would comprise one ridge beam 101, two truss beams 102, two upper leg beams 103, two legs 104 and two lower leg beams 105. Further, an additional section, indicated by reference numeral 100*c*, could be added to two free-standing sections indicated as 100*a* and 100*b*, and would also comprise one ridge beam 101, two truss beams 102, two upper leg beams 103, two legs 104 and two lower leg beams 105. Further still, an alternative embodiment of a section could comprise one ridge beam that is attached to another structure in a well-known cantilever manner, two truss beams 102, two upper leg beams that are attached to the other structure in a well-known cantilever manner, two lower legs 104, and two lower leg beams that are attached to the other structure in a well-known cantilever manner.

While the exemplary embodiment of FIG. 1A-1D is shown as comprising three sections (sections 100*a*-100*c*), it should be understood that structure 100 could comprise any number of sections. Additionally, the various components forming structure 100 can be formed from any suitable material, such as, but not limited to, steel, metal alloys and/or composite materials, that provides sufficient strength for the stresses that are experienced by a structure such as structure 100.

Figure 5A:
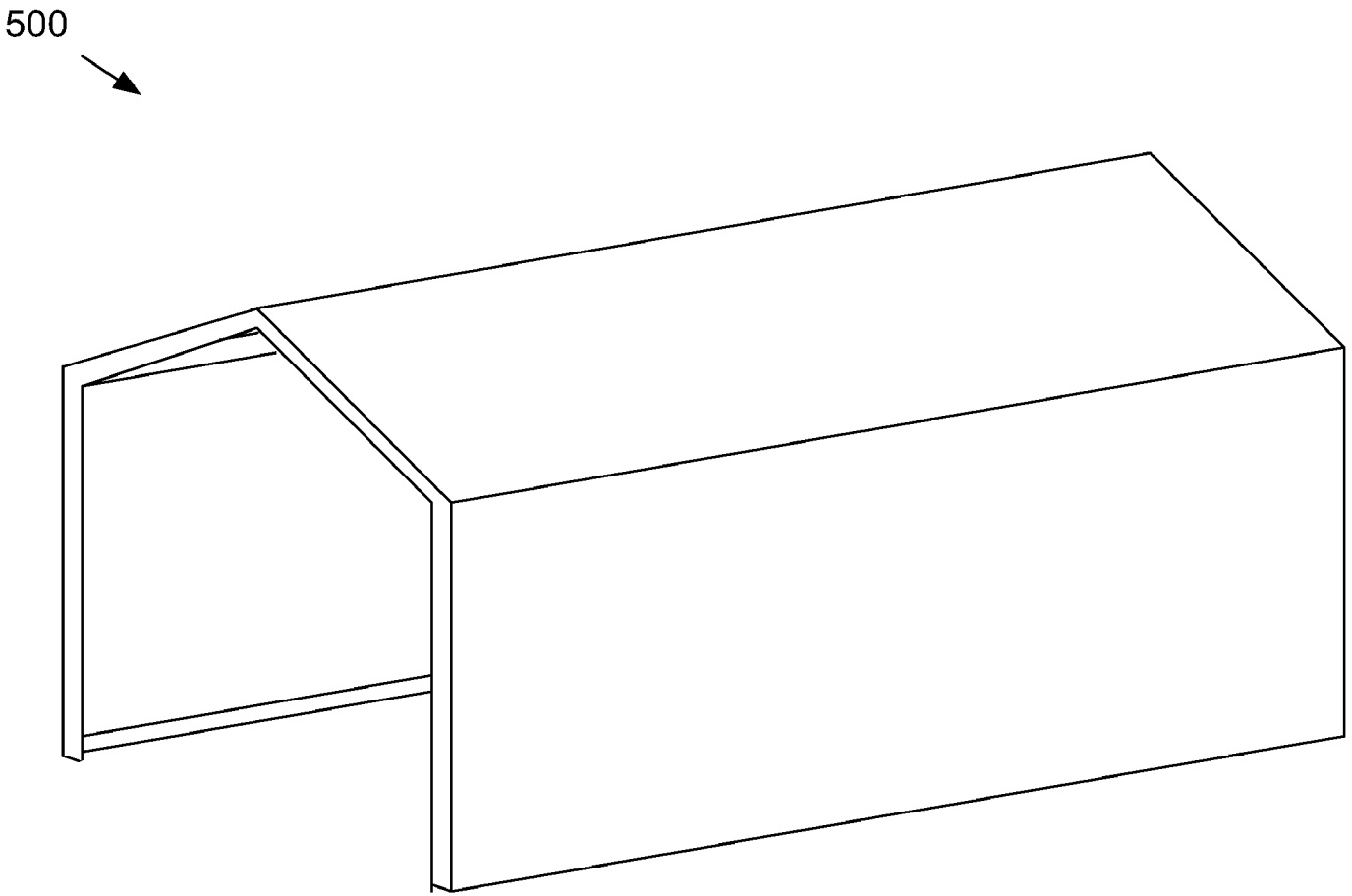
FIG. 5A depicts that exemplary structure 100 (FIGS. 1A-1D), or variations of exemplary structure 100, could be used as, but not limited to, a structure for a garage/canopy for a vehicle, a motorcycle, a bicycle, a covered walkway, a greenhouse, a party tent, an animal shelter, a pavilion tent, a temporary shelter, or a storage facility.
Figure 5B:
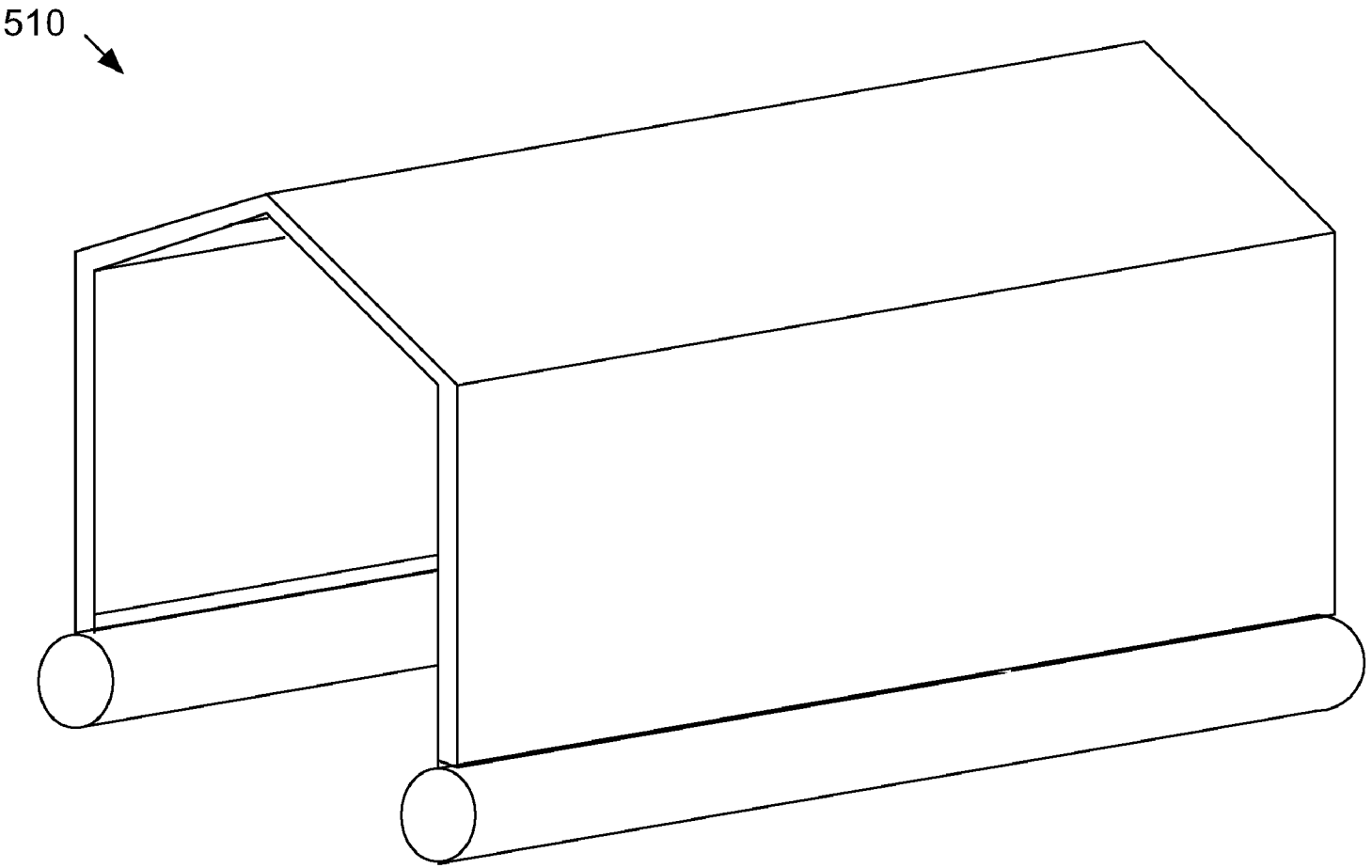
FIG. 5B depicts that exemplary structure 100 (FIGS. 1A-1D), or variations of exemplary structure 100, could be used as, but not limited to, a structure for a boat garage/canopy.

Exemplary structure 100, or variations of exemplary structure 100, could be used as, but not limited to, a structure for a garage/canopy for a vehicle, a motorcycle, a bicycle, a covered walkway, a greenhouse, a party tent, an animal shelter, a pavilion tent, a temporary shelter, or a storage facility (500 in FIG. 5A). Further, exemplary structure 100, or variations of exemplary structure 100, could be used as, but not limited to, a structure for a boat garage/canopy (510 in FIG. 5B). Additionally, it should be understood that exemplary structure 100, or variations of exemplary structure 100, could be scaled in size for the intended application. For example, one exemplary embodiment of structure 100 could be scaled in size for a garage/canopy for a Recreational Vehicle (RV), while another exemplary embodiment of structure 100 could be scaled in size for a garage/canopy for a motorcycle.

Figure 2A:
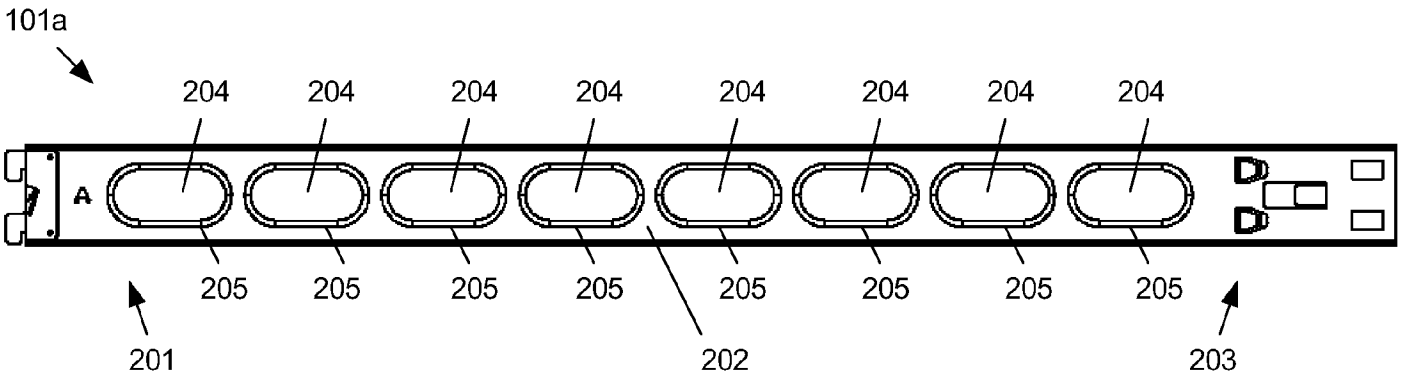
FIGS. 2A-2E show different views of an exemplary embodiment of a ridge beam member according to the subject matter disclosed herein.
Figure 2B:
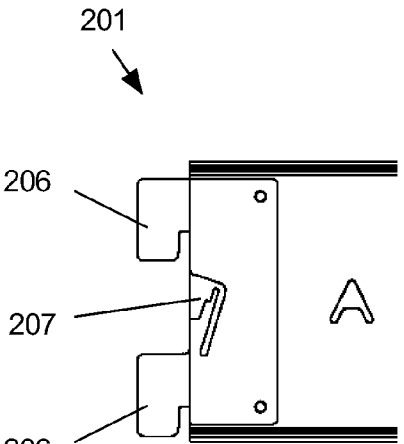

FIG. 2A shows a side view of an exemplary embodiment of a ridge beam member 101*a* according to the subject matter disclosed herein. Ridge beam member 101*a* comprises a first end 201, a middle portion 202 and a second end 203. In one exemplary embodiment, middle portion 202 comprises at least one aperture 204. In another exemplary embodiment, middle portion 202 comprises no apertures 204. In yet another exemplary embodiment, middle portion 202 comprises at least one aperture of a type that is different from aperture 204. One benefit of aperture 204 is weight reduction of ridge beam member 101*a*. Each aperture 204 comprises a bent edge 205 that can provide strengthening and increased rigidity for ridge beam member 101*a*. An exemplary embodiment of bent edge 205 of an aperture 204 is better seen in FIG. 2E. FIG. 2B shows that first end 201 of ridge beam member 101*a* comprises protrusion members 206 that mate with a corresponding slots, or apertures, 224 in an upper truss beam member 102*a* (FIG. 2G), and a locking member 207 that can be used for providing a locking mechanism when ridge beam member 101*a* is assembled as part of a structure 100. While FIG. 2B shows only two protrusion members 206, it should be understood that ridge beam 101*a* could comprise any number of protrusion members 206 depending on the particular embodiment. It should also be understood that locking member 207 could be omitted from ridge beam member 101*a*.

Figure 2C:
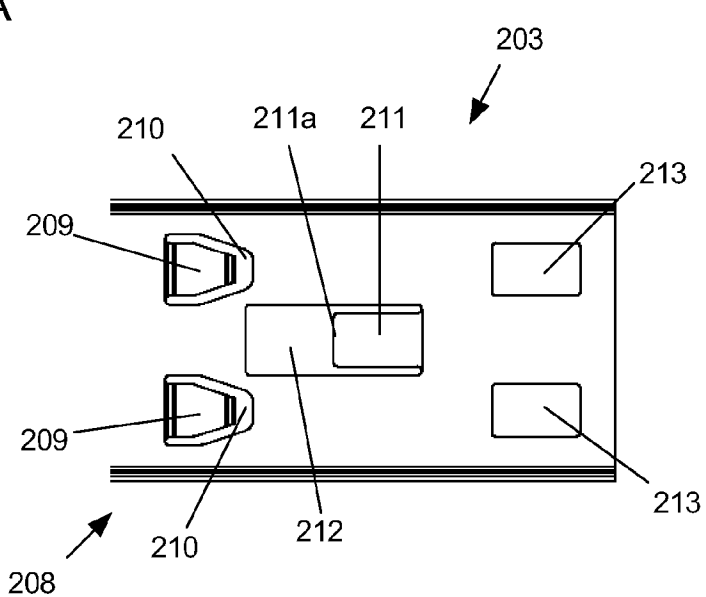

FIG. 2C shows that second end 203 comprises a coupling mechanism or lap joint 208. Coupling mechanism 208 comprises protrusion members 209 formed in apertures 210, a protrusion member 211 formed in an aperture 212, and apertures 213. A ridge beam member 101*b* is configured similar to a ridge beam member 101*a*. It should be understood that other exemplary embodiments of coupling mechanism 208 could comprise different numbers of protrusion members 209 formed in apertures 210, protrusion members 211 formed in aperture 212, and apertures 213.

Figure 2D:
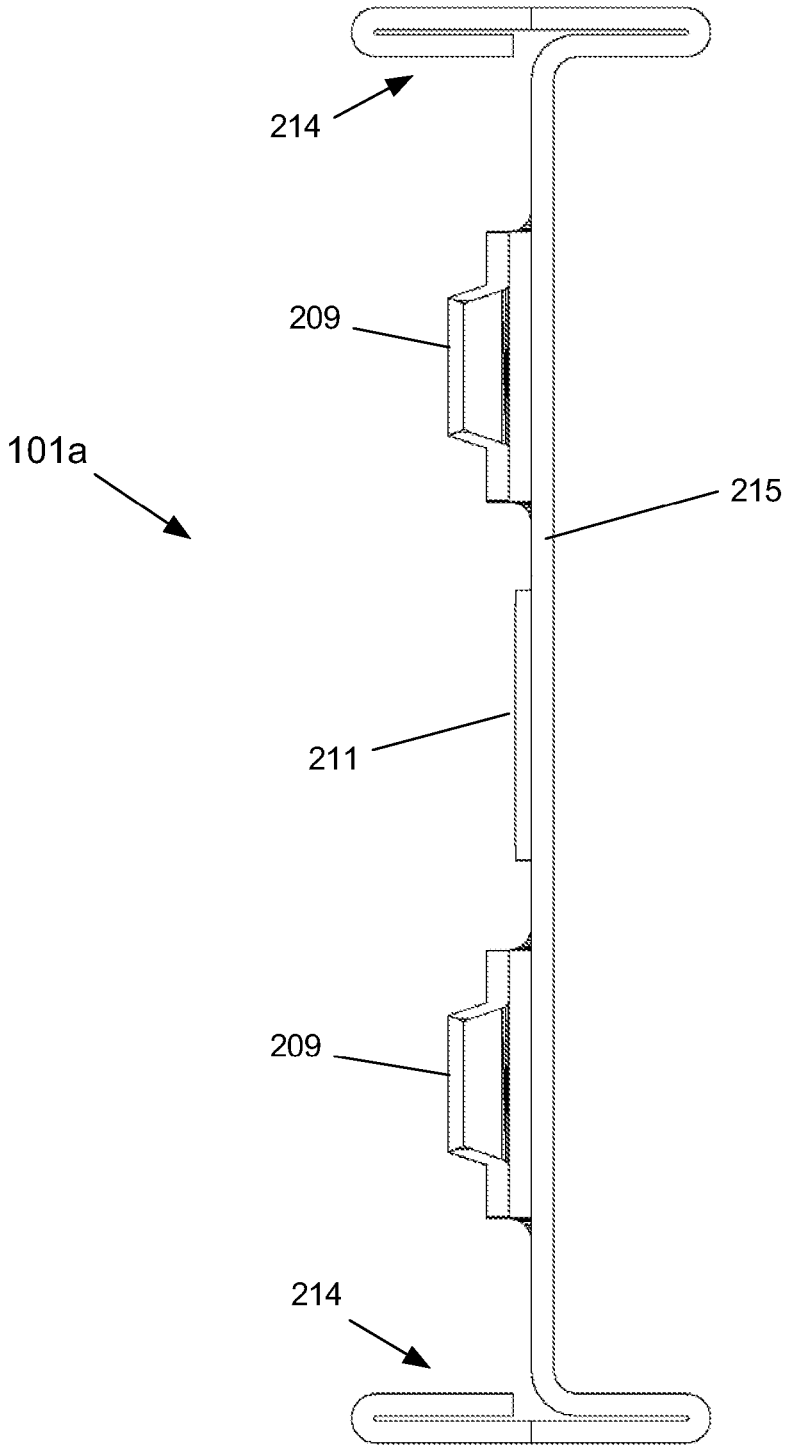

FIG. 2D shows an end view of ridge beam member 101*a* as viewed from second end 203. The end view shows that the cross-sectional shape of the ridge beam comprises a shape that corresponds to the cross-sectional shape of an I-beam. That is, the cross-sectional shape of ridge beam member 101*a* includes two flange members 214 disposed at each end of a web member 215. A bent edge 205 of an aperture 204 is not shown in FIG. 2D. While the end view shows ridge beam member 101*a* as being formed by a continuous piece of material that has been bent to form a shape corresponding to an I-beam, it should be understood that the ridge beam could be formed by, for example, flange members 214 being fastened to web member 215, such as, but not limited to by welding, press fit, gluing and/or casting or any other well-known technique.

Figure 2E:
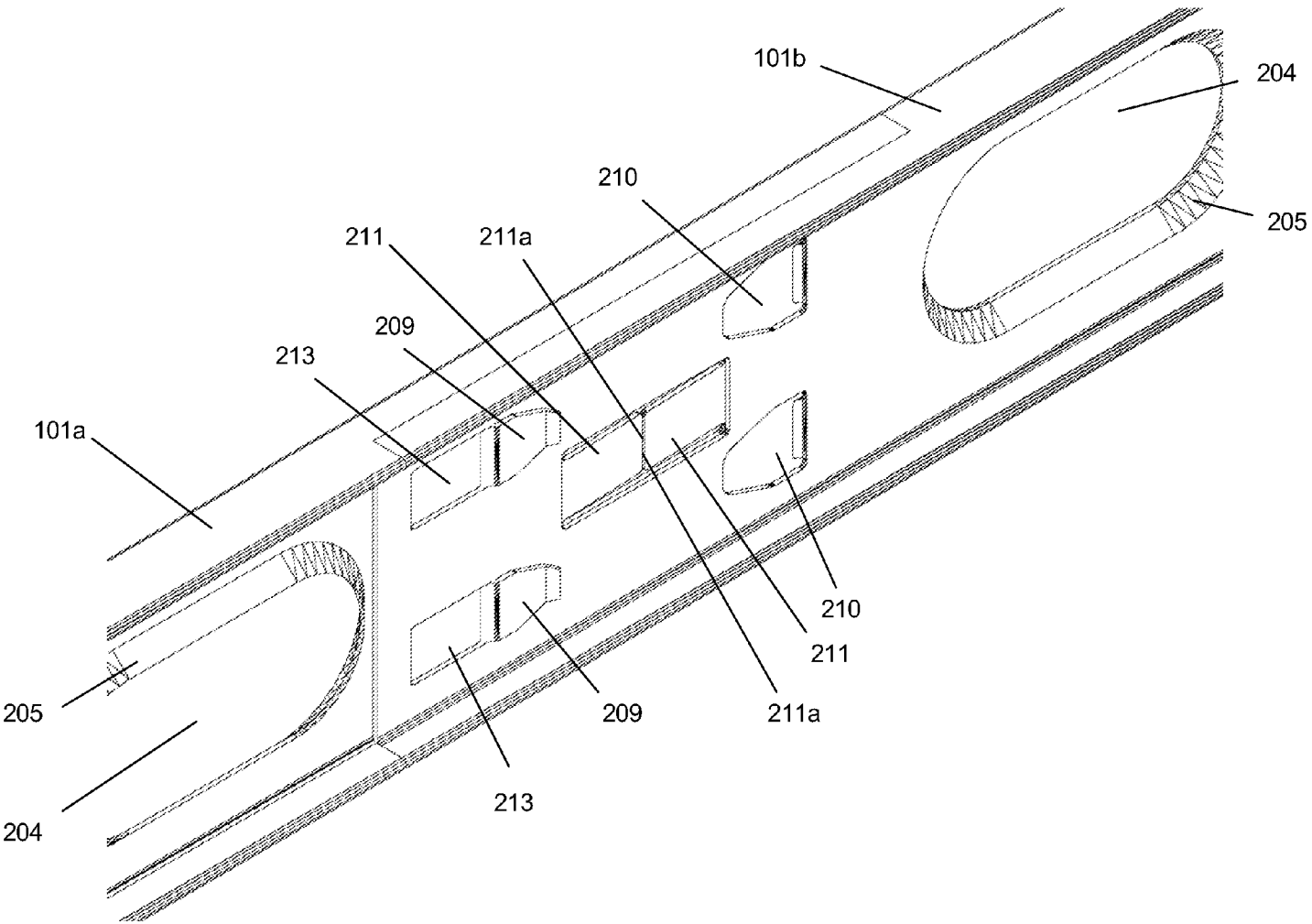

Coupling mechanism 208 mechanically couples ridge beam member 101*a* to a coupling mechanism 208 of a ridge beam member 101*b* to form ridge beam 101. To couple ridge beam member 101*a* to ridge beam member 101*b* to form ridge beam 101, protrusion members 209 of ridge beam member 101*a* are aligned with and fitted into apertures 213 of ridge beam member 101*b*. Similarly, protrusion members 209 of ridge beam member 101*b* are aligned with and fitted into apertures 213 of ridge beam member 101*a*. Protrusion member 211 of ridge beam member 101*a* is aligned with in contact with protrusion member 211 of ridge beam 101*b*. After the protrusion members of coupling mechanism 208 of ridge beam member 101*a* and 101*b* are aligned with and fitted into their corresponding apertures, ridge beam members 101*a* and 101*b* are pushed toward each other so that protrusion members 209 overlap a portion of web member 215 in proximity to the corresponding aperture 213 of the other ridge beam member. Protrusion members 211 slide past each other until they do not overlap each other and edge 211*a* of each protrusion member abuts providing a locking mechanism. FIG. 2E shows coupling mechanisms 208 of a ridge beam member 101*a* and a ridge beam member 101*b* coupled together to form a ridge beam 101. To disengage ridge beam member 101*a* from ridge beam member 101*b*, protrusion members 211 are physically pressed in the direction of their bend so that edges 211*a* do not abut and the respective beam members are then able to slide apart.

Figure 2F:
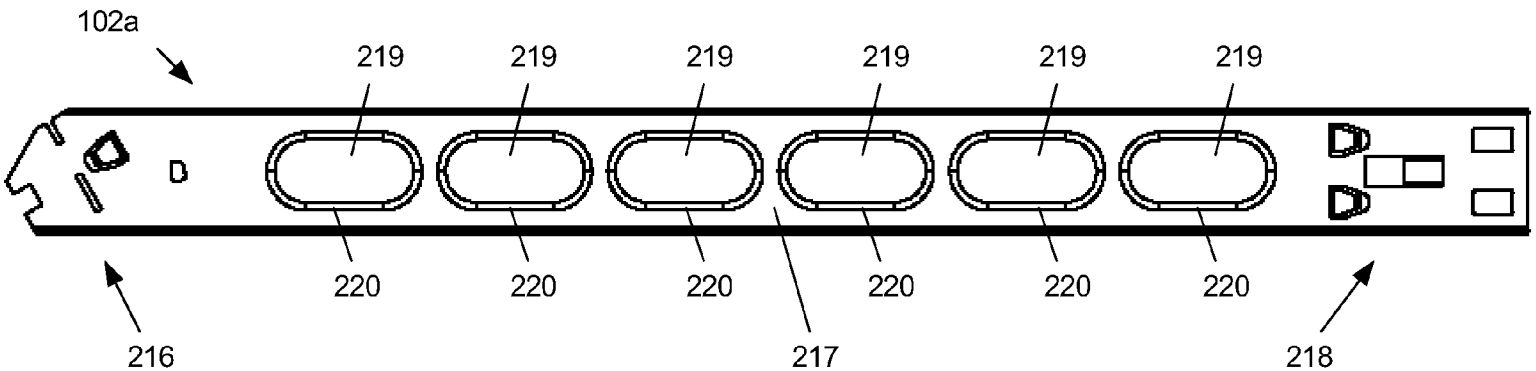
FIGS. 2F-2H show different views of an exemplary embodiment of an upper truss beam member according to the subject matter disclosed herein.

FIG. 2F shows a side view of an exemplary embodiment of an upper truss beam member 102*a* according to the subject matter disclosed herein. Upper truss beam member 102*a* comprises a first end 216, a middle portion 217 and a second end 218. In one exemplary embodiment, middle portion 217 comprises at least one aperture 219. In another exemplary embodiment, middle portion 217 comprises no apertures 219. In yet another exemplary embodiment, middle portion 217 comprises at least one aperture of a type that is different from aperture 219. One benefit of aperture 219 is weight reduction of upper truss beam member 102*a*. Each aperture 219 comprises a bent edge 220 that can provide strengthening and increased rigidity for upper truss beam member 102*a*. Bent edge 220 of an aperture 219 is better seen in FIG. 2I and/or FIG. 2J. Upper truss beam member 102*a* comprises a cross-sectional shape that is similar to the cross-sectional shape of ridge beam member 101*a*.

Figure 2G:
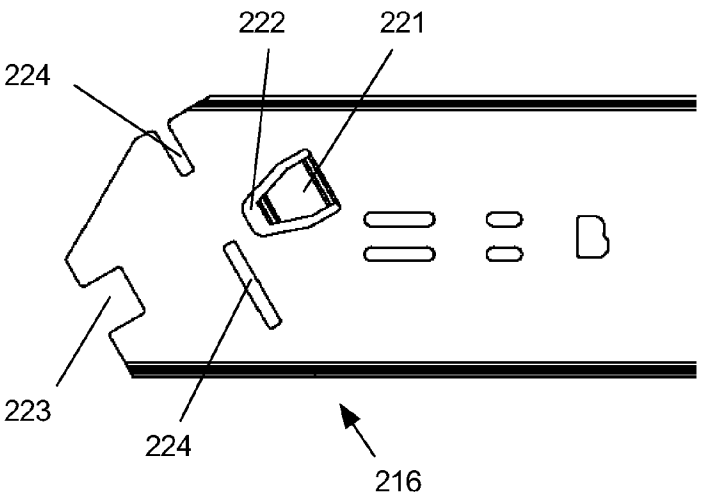

FIG. 2G shows that first end 216 of upper truss beam member 102*a* comprises a protrusion member 221 formed in an aperture 222, a slot (or aperture) 223 and slots (or apertures) 224. The first end 216 of an upper truss beam 102*a* mates with the first end 216 of another upper truss beam 102*a* by aligning protrusion 221 of each upper truss beam with slot 223 of the other upper truss beam, and then by sliding protrusion members 221 toward each other. When mated, slots 224 of each upper truss beam align for receiving protrusion members 206 of a ridge beam member 101*a* (FIG. 2B). In one exemplary embodiment, slots 224 comprise a sufficient width for receiving protrusion members 206 of different ridge beam members 101*a* at the junction of two sections of a structure 100. FIG. 2I shows a perspective view of two upper truss beam members 102*a* assembled with one ridge beam at the end of a structure 100. FIG. 2J shows a perspective view of two upper truss beam members 102*a* assembled with two ridge beams at the junction of two sections of a structure 100.

Figure 2H:
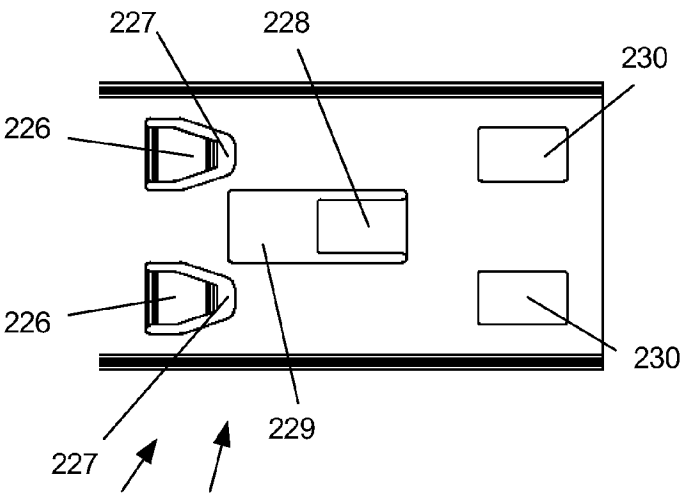
Figure 2I:
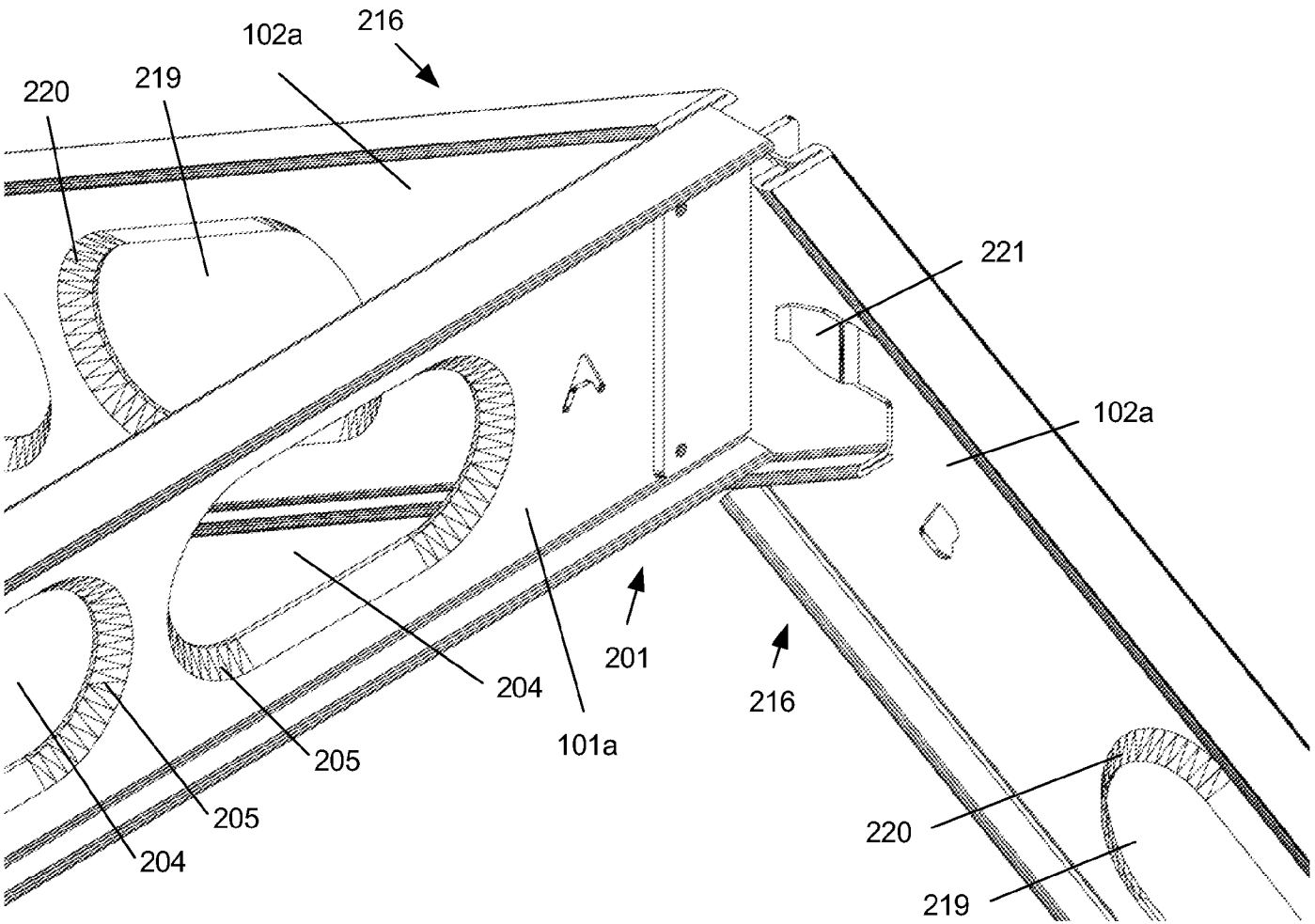
FIG. 2I shows a perspective view of the exemplary embodiment of the upper truss beam member shown in FIG. 2F assembled with an exemplary embodiment of a ridge beam member according to the subject matter disclosed herein.
Figure 2J:
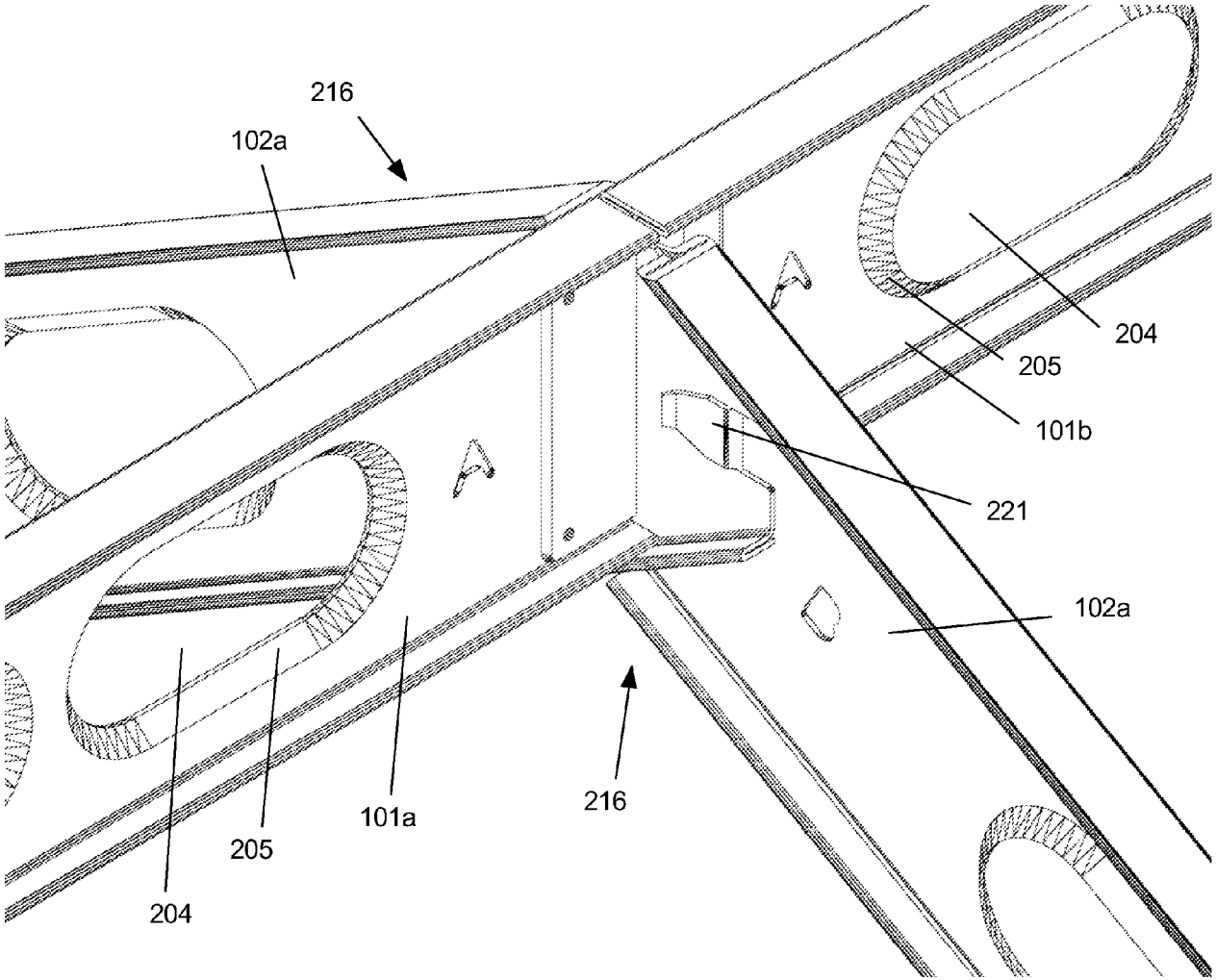
FIG. 2J shows a perspective view of the exemplary embodiment of the upper truss beam member shown in FIG. 2F assembled with an exemplary embodiment of a ridge beam member according to the subject matter disclosed herein.

FIG. 2H shows that second end 218 comprises a coupling mechanism or lap joint 225. Coupling mechanism 225 comprises protrusion members 226 formed in apertures 227, a protrusion member 228 formed in an aperture 229, and apertures 230. Coupling mechanism 225 mechanically couples an upper truss beam member 102*a* to a lower truss beam member 102*b* in a manner similar to that shown in FIG. 2E.

Figure 2K:
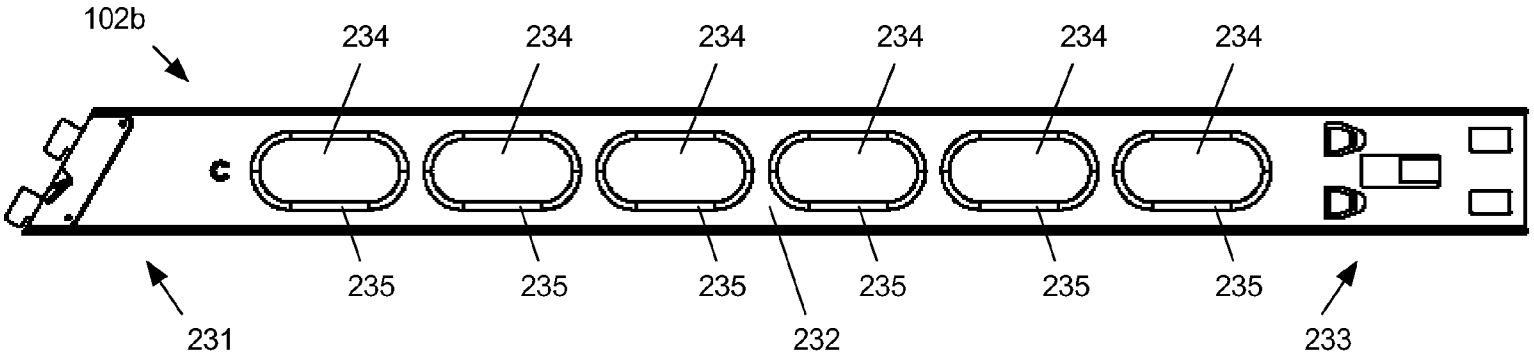
FIG. 2K shows a side view of an exemplary embodiment of a lower truss beam member according to the subject matter disclosed herein.

FIG. 2K shows a side view of an exemplary embodiment of a lower truss beam member 102*b* according to the subject matter disclosed herein. Lower truss beam member 102*b* comprises a first end 231, a middle portion 232 and a second end 233. In one exemplary embodiment, middle portion 232 comprises at least one aperture 234. In another exemplary embodiment, middle portion 232 comprises no apertures 234. In yet another exemplary embodiment, middle portion 232 comprises at least one aperture of a type that is different from aperture 234. One benefit of aperture 234 is weight reduction of lower truss beam member 102*b*. Each aperture 234 comprises a bent edge 235 that can provide strengthening and increased rigidity for lower truss beam member 102*b*. Bent edge 235 of an aperture 234 is better seen in FIG. 2N and/or FIG. 2O. Lower truss beam member 102*b* comprises a cross-section shape that is similar to the cross-sectional shape of ridge beam member 101*a*.

Figure 2M:
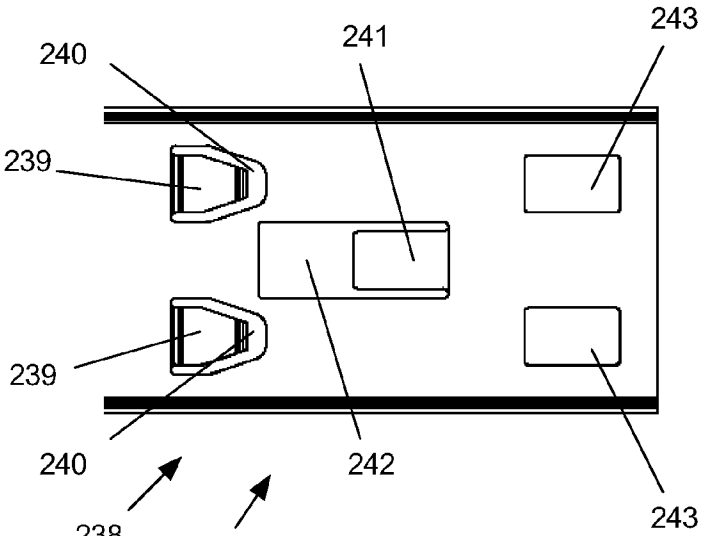
FIGS. 2L and 2M respectively shows first and second ends of an exemplary embodiment of the lower truss beam member shown in FIG. 2K.
Figure 2L:
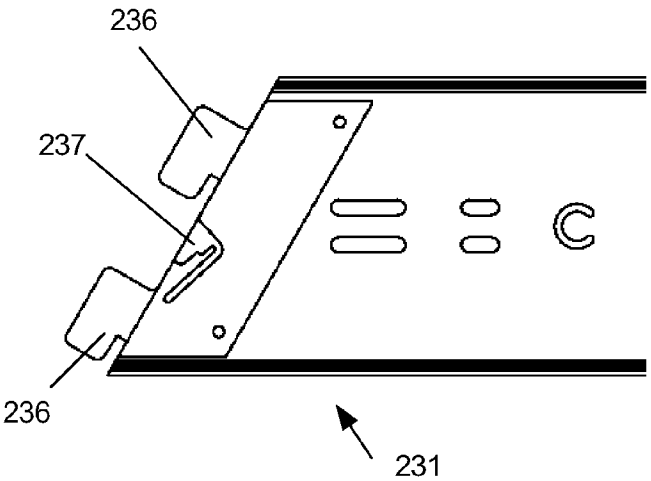
Figure 2N:
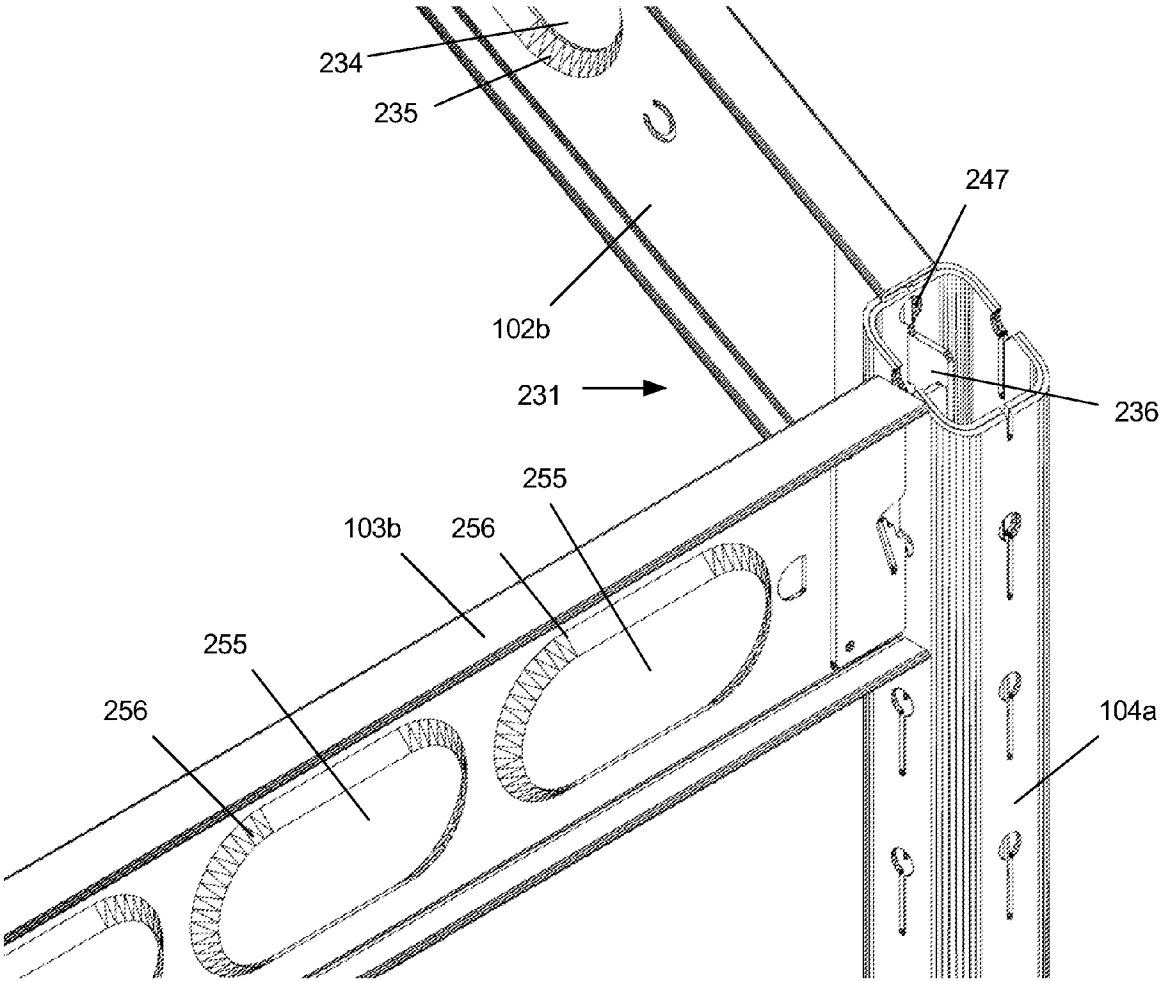
FIG. 2N shows the exemplary embodiment of the lower truss beam member shown in FIG. 2K assembled with an exemplary embodiment of an upper leg member and an exemplary embodiment of an upper leg beam member at a corner of a structure according to the subject matter disclosed herein.
Figure 2O:
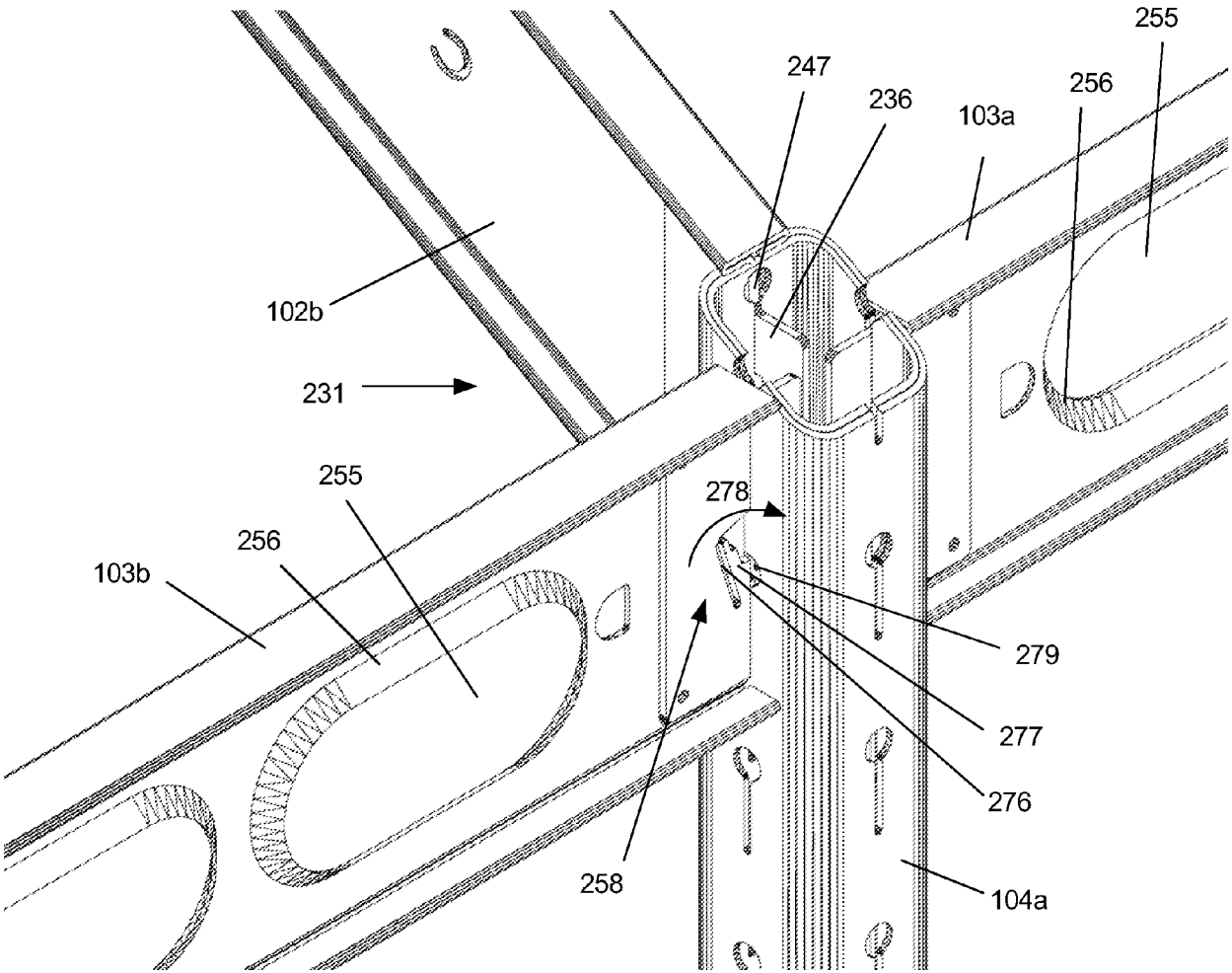
FIG. 2O shows the exemplary embodiment of the lower truss beam member shown in FIG. 2K assembled with an exemplary embodiment of an upper leg member and an exemplary embodiment of an upper leg beam member at a junction of two sections of a structure according to the subject matter disclosed herein.

FIG. 2L shows that first end 231 of lower truss beam member 102*b* comprises protrusion members 236 that mate with keyhole apertures 247 in an upper leg member 104*a* (FIGS. 2N and 2O), and a locking member 237 that can be used for providing a locking mechanism when lower truss beam member 102*b* is assembled as part of a structure 100. FIG. 2N shows a lower truss beam member 102*b* assembled with an upper leg member 104*a* and an upper leg beam member 103*b* at a corner of a structure 100. FIG. 2O shows a lower truss beam member 102*b* assembled with an upper leg member 104*a* and an upper leg beam member 103*b* at a junction of two sections of a structure 100.

FIG. 2M shows that second end 233 comprises a coupling mechanism or lap joint 238. Coupling mechanism 238 comprises protrusion members 239 formed in apertures 240, protrusion member 241 formed in aperture 242, and apertures 243. Coupling mechanism 238 mechanically couples a lower truss beam member 102*b* to an upper truss beam member 102*a* in a manner similar to that shown in FIG. 2E.

Figure 2P:
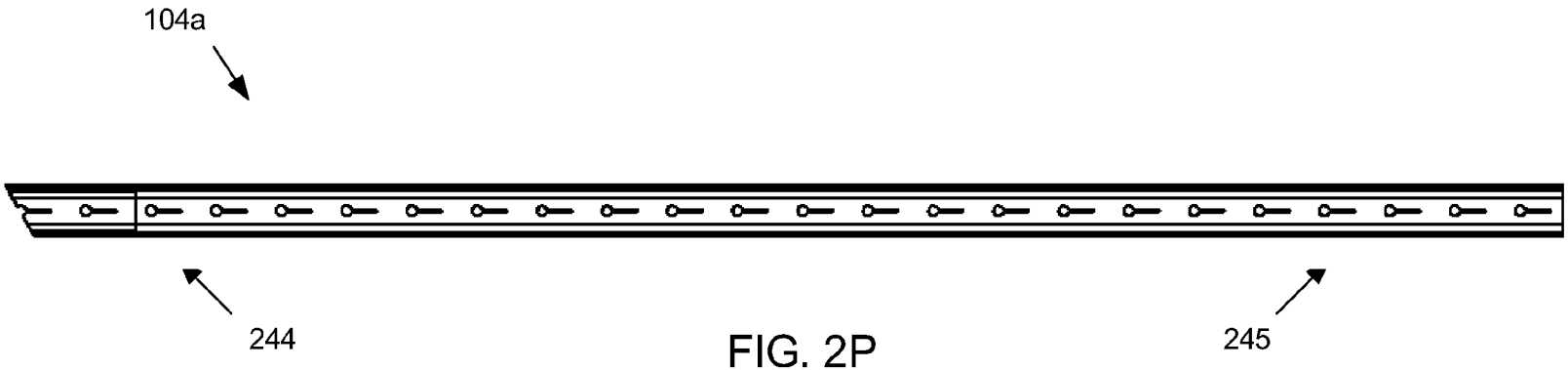
FIGS. 2P-2R respectively show difference views of an exemplary embodiment of an upper leg member according to the subject matter disclosed herein.
Figure 2R:
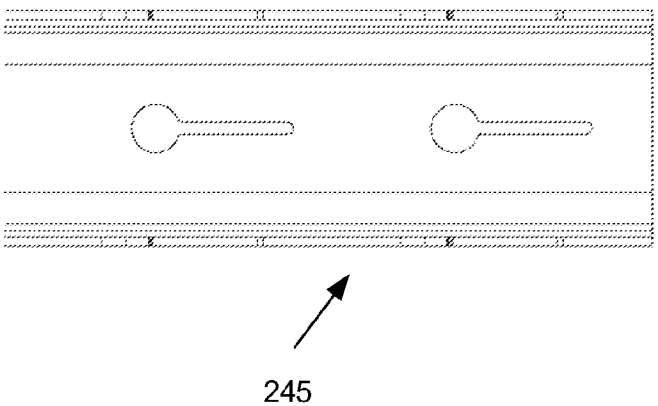
Figure 2Q:
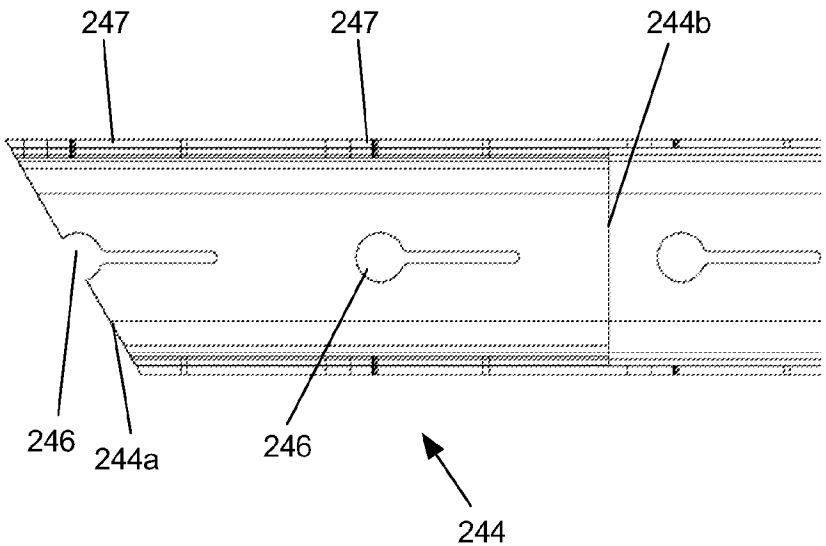

FIG. 2P shows a side view of an exemplary embodiment of an upper leg member 104*a* according to the subject matter disclosed herein. FIG. 2P shows that upper leg member 104*a* comprises a first end 244 and a second end 245. FIG. 2Q shows that first end 244 comprises a plurality of keyhole apertures 246 that mate with protrusion members 257 of an upper leg beam member 103*a* (FIG. 2X) and a plurality of keyhole apertures 247 (not shown in FIG. 2Q) that mate with protrusion members 236 of a lower truss beam 102*b* (FIG. 2L). Keyhole apertures 246 and 247 are identified using different reference numerals because orientation of an upper leg member 104*a* is critical so that angled edge 244*a* aligns correctly with the angled pitch formed by a truss beam 102. Additionally, keyhole apertures 246 are on opposing sides of upper leg member 104*a* that mate with upper leg beams 103 and lower leg beams 105. Keyhole apertures 247 have corresponding keyhole apertures on the opposite side of upper leg member 104*a*. Vertical line 244*b* is shown in FIG. 2Q to indicate that first end 244 can comprise a wall strengthening member that increases the wall thickness of first end 244 in the vicinity of where an upper leg beam 103 couples to a first end 244 of an upper leg member 104*a*. In one exemplary embodiment, the strengthening member is internal to upper leg member 104*a*. In another exemplary embodiment, the strengthening member is external to upper leg member 104*a*. Second end 245, shown in FIG. 2R, couples to first end 249 of a lower leg member 104*b* (FIG. 2U) by fitting around lower leg member 104*b*. Alternatively, second end 245 could couple to first end 249 of lower leg member 104*b* by fitting inside lower leg member 104*b*.

Figure 2S:
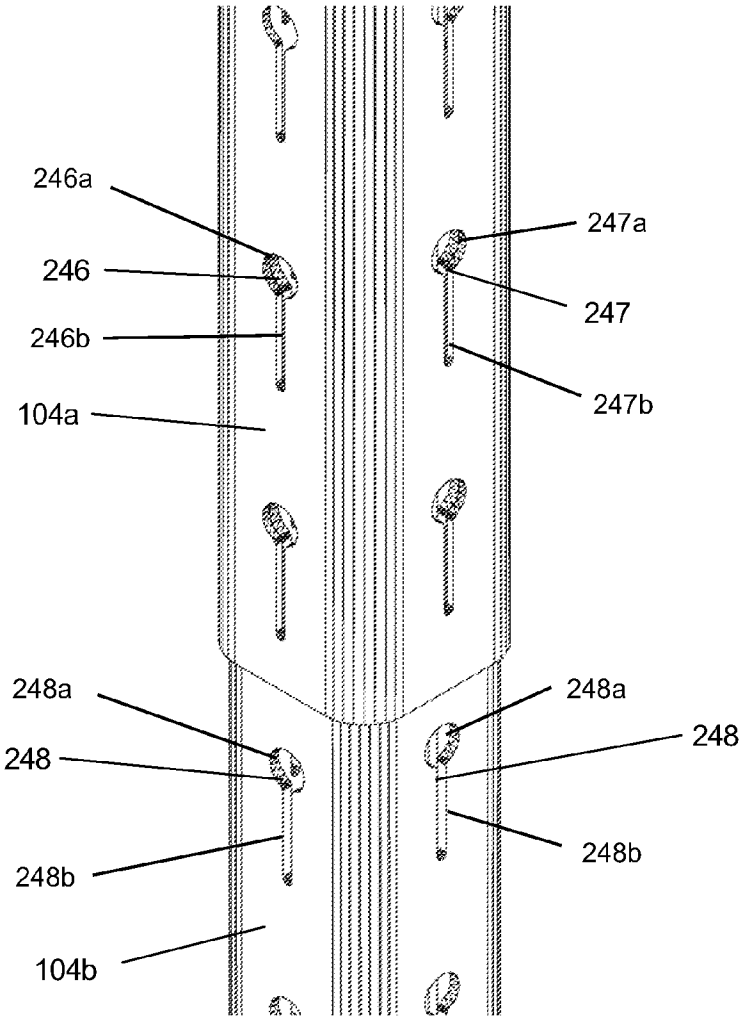
FIG. 2S shows an exemplary embodiment of an upper leg member assembled with an exemplary embodiment of a lower leg member as part of a structure according to the subject matter disclosed herein.

FIG. 2S shows an upper leg member 104*a* assembled with a lower leg member 104*b* as part of a structure 100. As shown in FIG. 2S, upper leg member 104*a* fits around lower leg member 104*b*, and both upper and lower leg members 104*a* and 104*b* respectively comprise a plurality of keyhole apertures 246 and 247, and keyhole apertures 248. Each keyhole aperture 246 comprises a round portion 246*a* and a slot portion 246*b*. Similarly, each keyhole aperture 247 comprises a round portion 247*a* and a slot portion 247*b*, and each keyhole aperture 248 comprises a round portion 248*a* and a slot portion 248*b*. A fastening member (not shown) fits into the round portion of two aligned keyhole apertures in a well-known manner. Exemplary fastening members that could be used comprise pins held in place with a cotter pin, a bolt fitted with a nut. It should be understood that apertures 246, 247 and 248 could comprise other suitable shapes. It should also be understood that another mechanism, such as a compression clamp, albeit less suitable, could be used for making the length of a leg continuously adjustable.

FIG. 2N shows a lower truss beam member 102*a* assembled with an upper leg member 104*a* and an upper leg beam member 103*b* at a corner of a structure 100. FIG. 2O shows a lower truss beam member 102*a* assembled with an upper leg member 104*a* and an upper leg beam member 103*b* at a junction of two sections of a structure 100.

The overall height of a leg 104 can be selected by sliding a lower leg member 104*b* into an upper leg member 104*a* to the desired overall height and inserting a fastening member into the round portion of aligned keyhole apertures in the lower and upper leg members. Thus, the overall height of a particular leg 104 can be adjusted to accommodate an uneven ground or surface on which a structure 100 is assembled. The variation in available leg height adjustment is between the height of an upper leg member 104*a* to the height of an attached upper leg member 104*a* plus a lower leg member 104*b* less the amount of length used for coupling upper leg member 104*a* to lower leg member 104*b*.

In one exemplary embodiment, the spacing between adjacent keyhole apertures 246 along an upper leg member 104*a* is selected to be the same as the spacing between adjacent apertures 247. In another exemplary embodiment, keyhole apertures 246 are aligned with keyhole apertures 247 along upper leg member 104*a*. In another exemplary embodiment, keyhole apertures 246 and 247 are offset from each other along upper leg member 104*a*. In one exemplary embodiment, keyhole apertures 248 are aligned with keyhole apertures 248 on the other sides of lower leg member 104*b* along lower leg member 104*b*. In another exemplary embodiment, keyhole apertures 248 are aligned with keyhole apertures 248 on the opposite side of lower leg member 104*b* and are offset from keyhole apertures on adjacent sides of lower leg member 104*b*. In one exemplary embodiment, the spacing between adjacent keyhole apertures 246 (and 247) is selected to be different from the spacing between adjacent keyhole apertures 248. The difference between the spacing of keyhole apertures 246 (and 247) and 248 is the resolution with which a selected leg height can be selected. For example, if the spacing between keyhole apertures 246 (and 247) is 1" and the spacing between keyhole apertures 248 is 0.9", the resolution with which a selected leg height can be chosen is 0.1". If there is no difference between the keyhole spacing, then the resolution with which a selected leg height can be chosen is the spacing between the keyhole apertures. For example, if the spacing between adjacent keyhole apertures is 1", then the resolution with which a selected leg height can be chosen is 1".

Figure 2T:
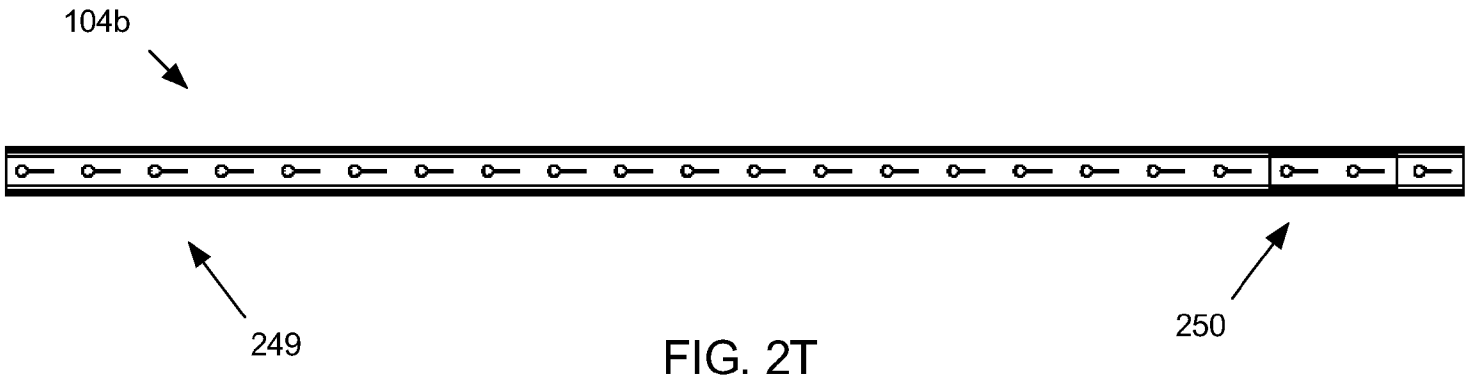
FIGS. 2T-2V respectively show different views of an exemplary embodiment of a lower leg member according to the subject matter disclosed herein.
Figure 2V:
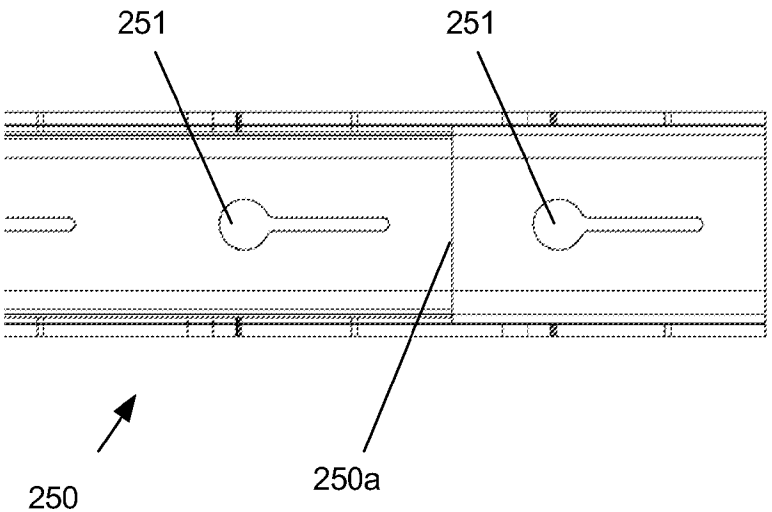
Figure 2U:
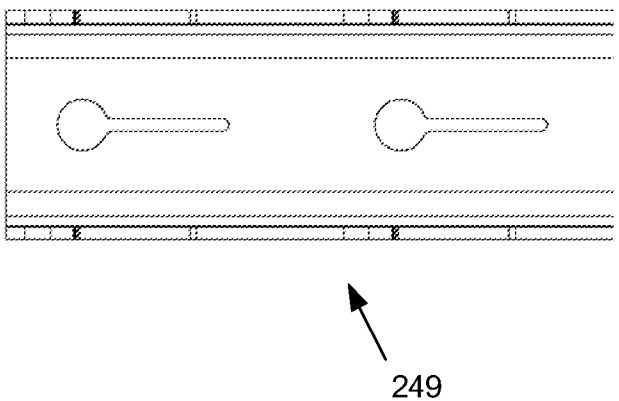

FIG. 2T shows a side view of an exemplary embodiment of a lower leg member 104*b* according to the subject matter disclosed herein. FIG. 2T shows that lower leg member 104*b* comprises a first end 249 and a second end 250. First end 249, shown in FIG. 2U, mates to second end 245 of an upper leg member 104*a* (FIG. 2Q) by fitting inside upper leg member 104*a*. FIG. 2V shows that second end 250 comprises slots 251 that couple with protrusion members 268 of a lower leg beam member 105*a* (FIG. 2AA). Vertical line 250*a* is shown in FIG. 2V to indicate that second end 250 can comprise a wall strengthening member that increases the wall thickness of second end 250 in the vicinity of where a lower leg beam 105 couples to second end 250 of a lower leg member 104*b*. In one exemplary embodiment, the strengthening member is internal to lower leg member 104*b*. In another exemplary embodiment, the strengthening member is external to lower leg member 104*b*. FIG. 2S shows an upper leg member 104*a* assembled with a lower leg member 104*b* as part of a structure 100. As shown in FIG. 2S, upper leg member 104*a* fits around lower leg member 104*b*, and both upper and lower leg members 104*a* and 104*b* comprise a plurality of apertures 248 (not identified with reference numerals in FIGS. 2P-2R or FIGS. 2T-2V).

Figure 2W:
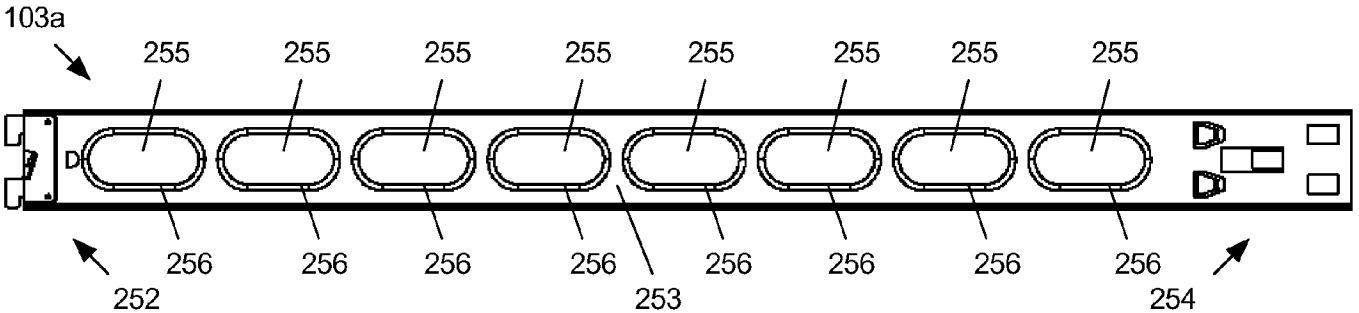
FIGS. 2W-2Y respectively show different views of an exemplary embodiment of an upper leg beam member according to the subject matter disclosed herein.
Figure 2Y:
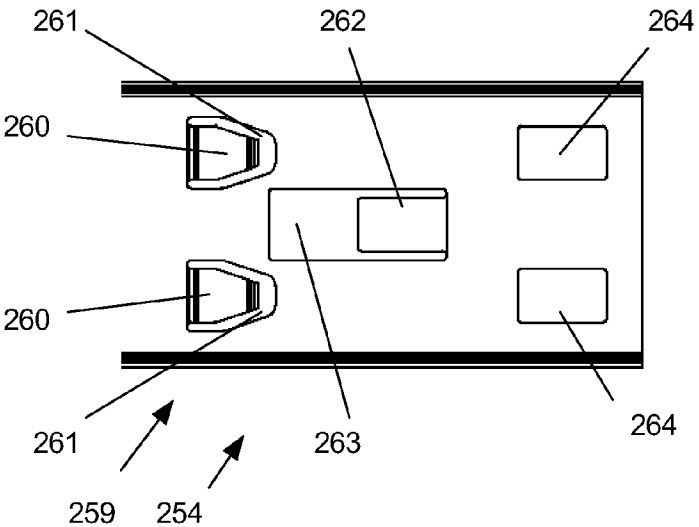
Figure 2X:
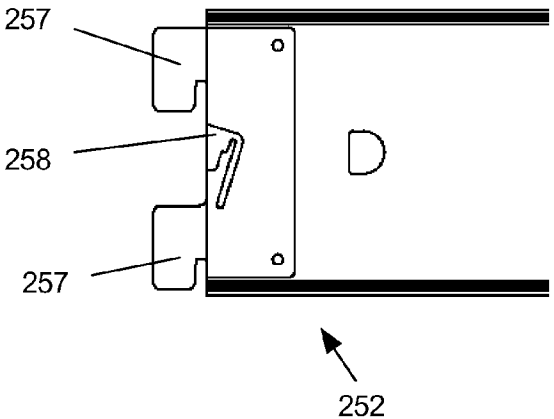

FIG. 2W shows a side view of an exemplary embodiment of an upper leg beam member 103*a* according to the subject matter disclosed herein. Upper leg beam member 103*a* comprises a first end 252, a middle portion 253 and a second end 254. In one exemplary embodiment, middle portion 253 includes at least one aperture 255. In another exemplary embodiment, middle portion 253 comprises no apertures 255. In yet another exemplary embodiment, middle portion 252 comprises at least one aperture of a type that is different from aperture 255. One benefit of aperture 255 is weight reduction of upper leg beam member 103*a*. Each aperture 255 comprises a bent edge 256 that can provide strengthening and increased rigidity for upper leg beam member 104*a*. Bent edge 256 of an aperture 255 is better seen in FIG. 2N and/or FIG. 2O. Upper leg beam member 103*a* comprises a cross-section shape that is similar to the cross-sectional shape of ridge beam member 101*a*. FIG. 2X shows that first end 252 of upper leg beam member 103*a* comprises protrusion members 257 that mate with slots 246 in an upper leg member 104*a* (FIG. 2Q), and a locking member 258 that can be used for providing a locking mechanism when upper leg beam member 103*a* is assembled as part of a structure 100. While FIG. 2X shows only two protrusion members 257, it should be understood that upper leg beam member 103*a* could comprise any number of protrusion members 257. FIG. 2Y shows that second end 254 comprises a coupling mechanism or lap joint 259. Coupling mechanism 259 comprises protrusion members 260 formed in apertures 261, a protrusion member 262 formed in aperture 263, and apertures 264. An upper leg beam member 103*b* is configured similar to an upper leg beam member 103*a*. Coupling mechanism 259 mechanically couples an upper leg beam member 103*a* to a coupling mechanism 259 of an upper leg beam member 103*b* to form an upper leg beam 103 in a manner similar to that shown in FIG. 2E.

FIG. 2N shows a lower truss beam member 102*a* assembled with an upper leg member 104*a* and an upper leg beam member 103*b* at a corner of a structure 100. FIG. 2O shows a lower truss beam member 102*a* assembled with an upper leg member 104*a* and an upper leg beam member 103*b* at a junction of sections of a structure 100.

Figure 2Z:
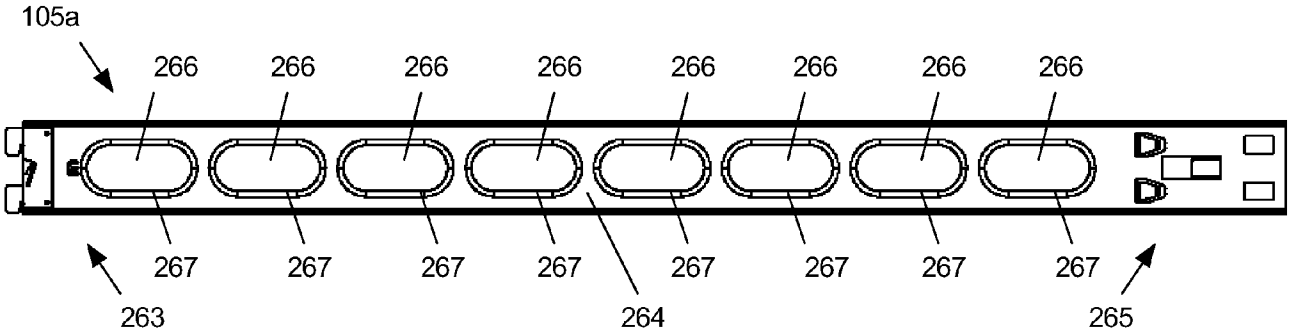
Figure 2A:
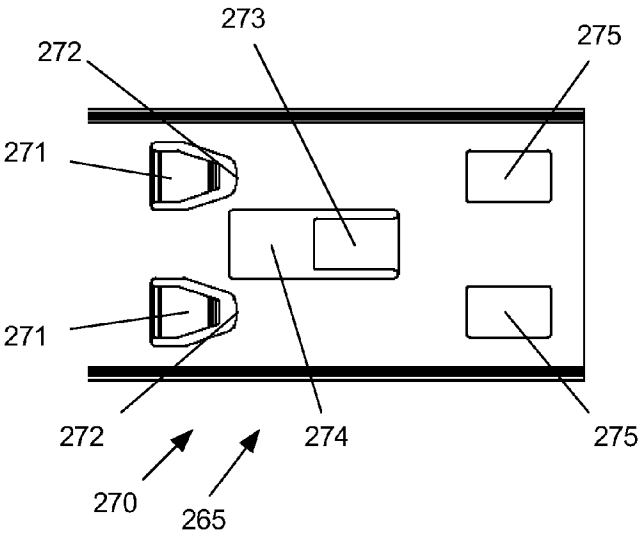
Figure 2A:
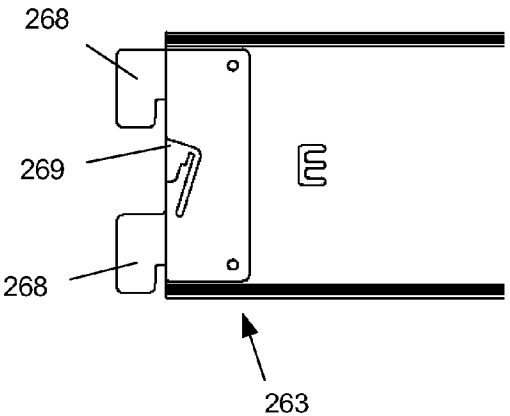
Figure 2A:
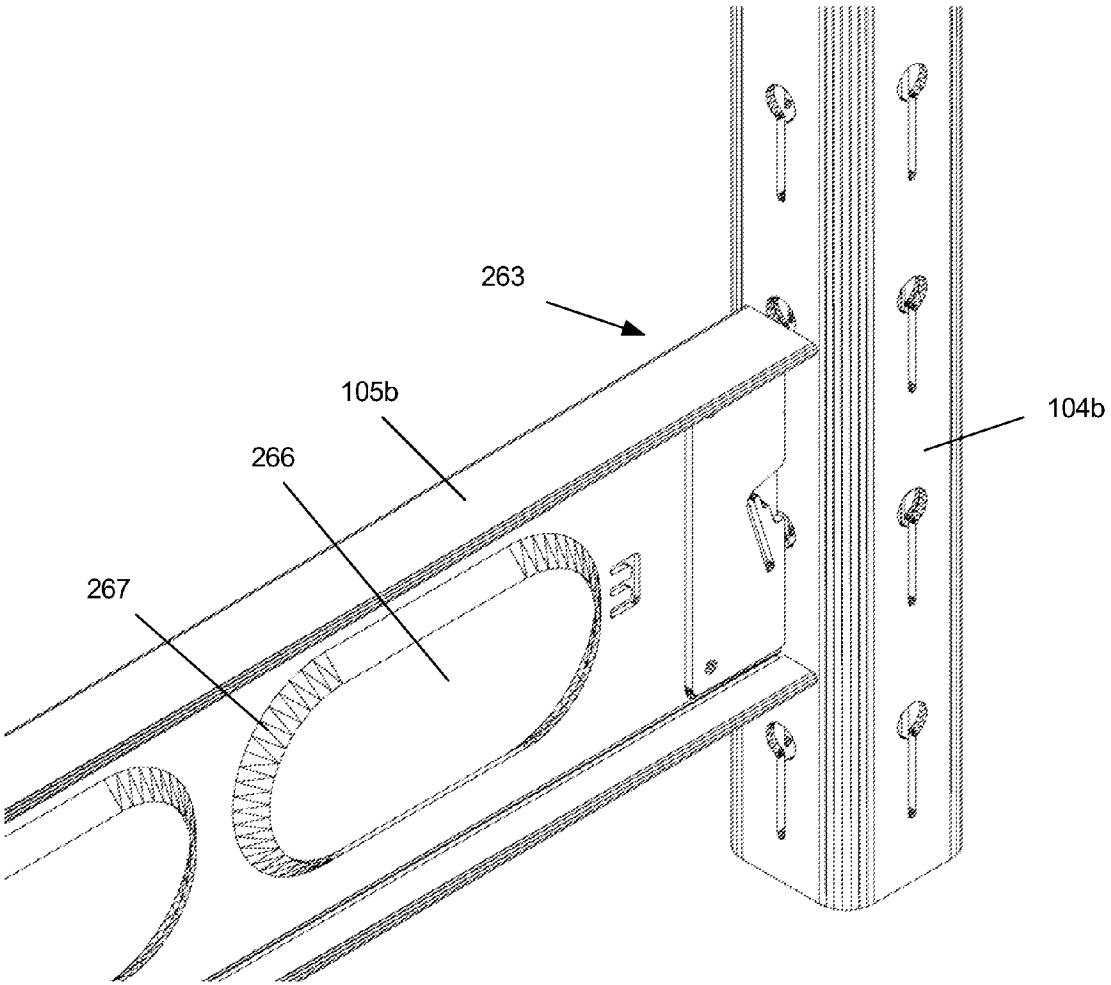
Figure 2A:
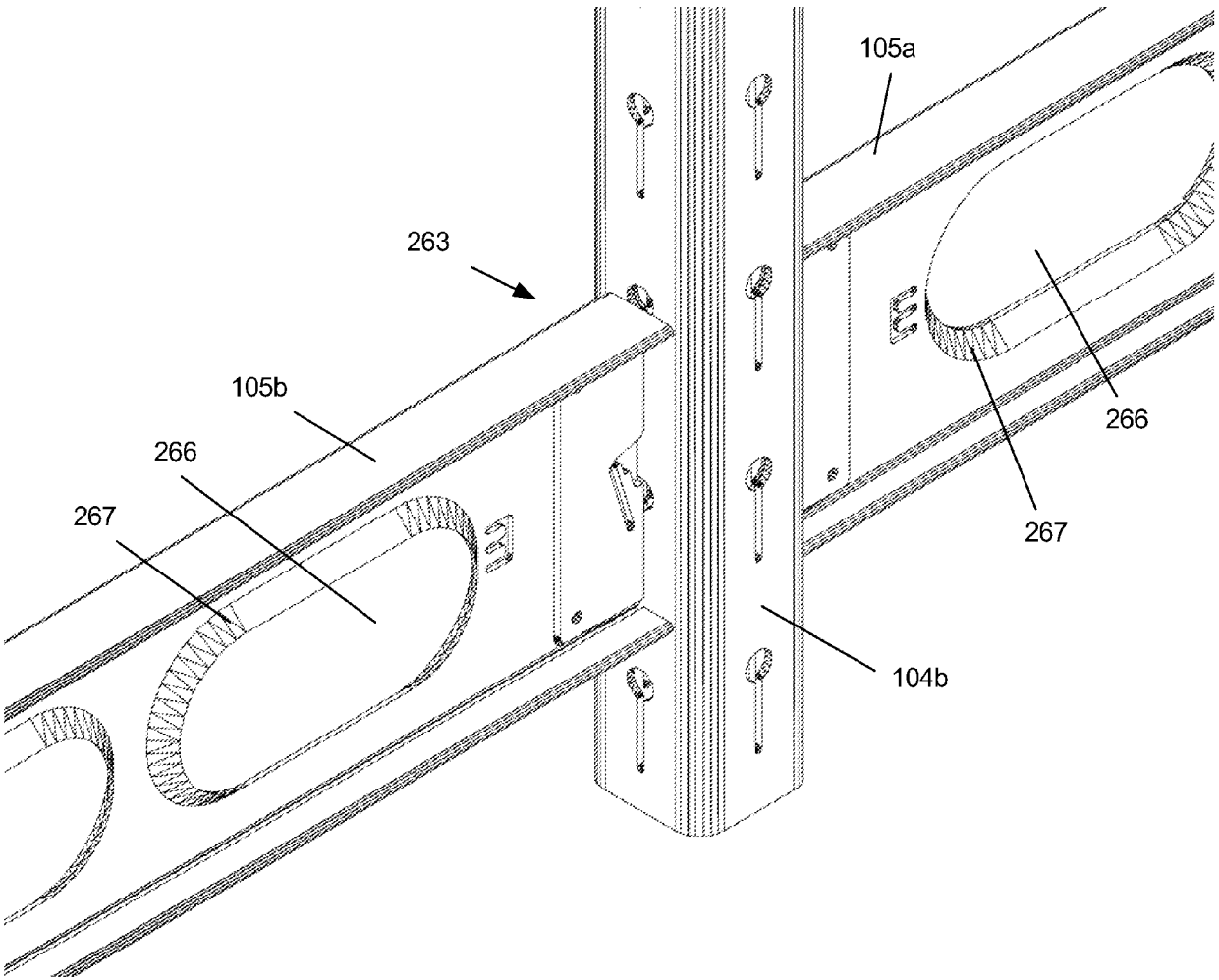
Figure 3A:
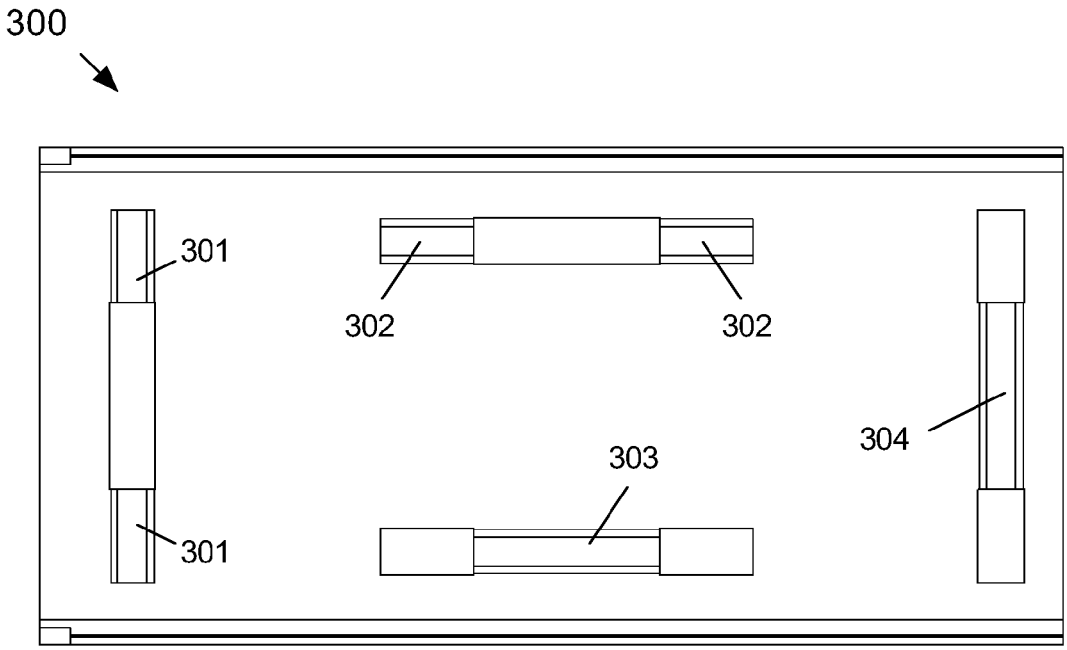
FIGS. 3A-3D respectively depict front, right side, top and isometric view of an exemplary alternative embodiment of a coupling mechanism for a beam and/or a truss beam according to the subject matter disclosed herein.
Figure 3B:
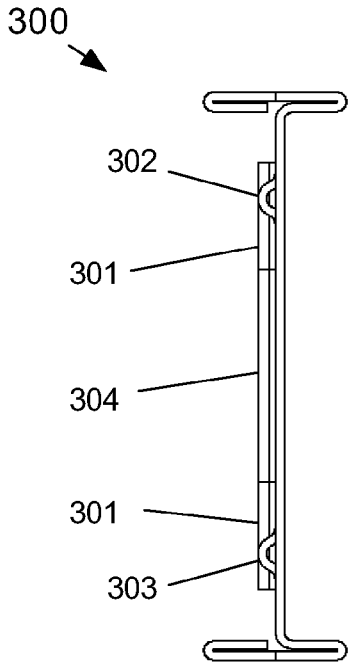
Figure 3C:
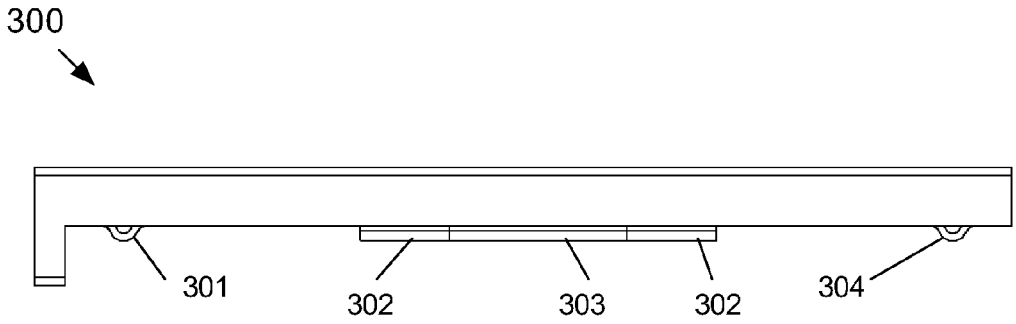
Figure 3D:
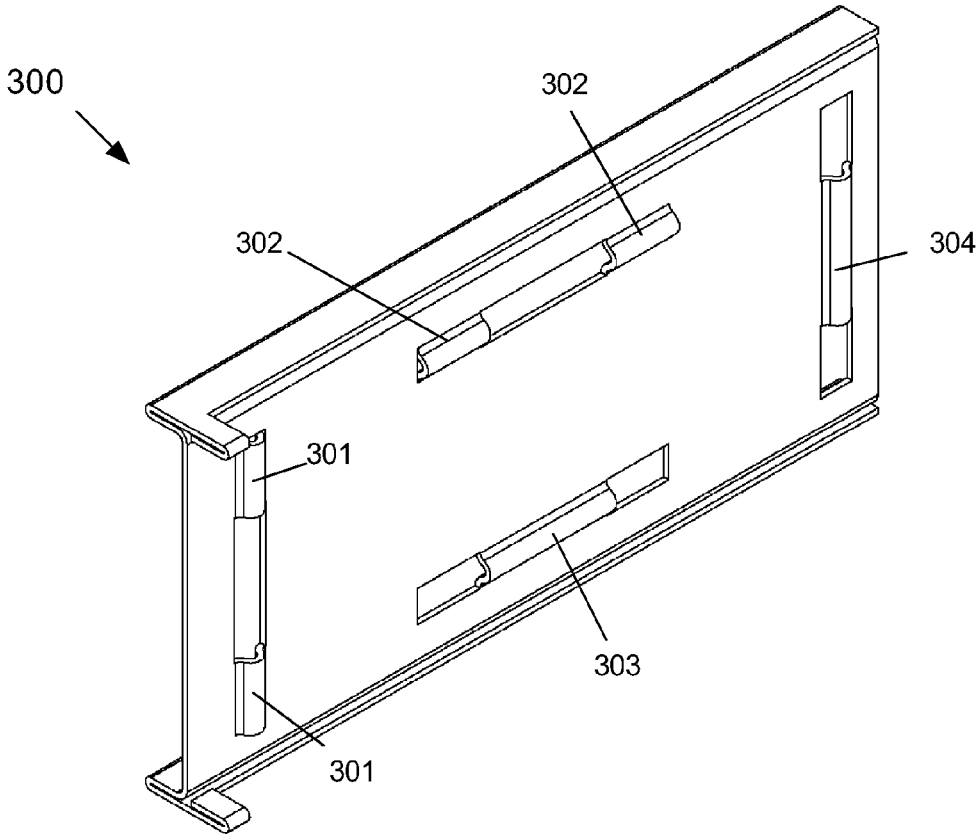
Figure 3E:
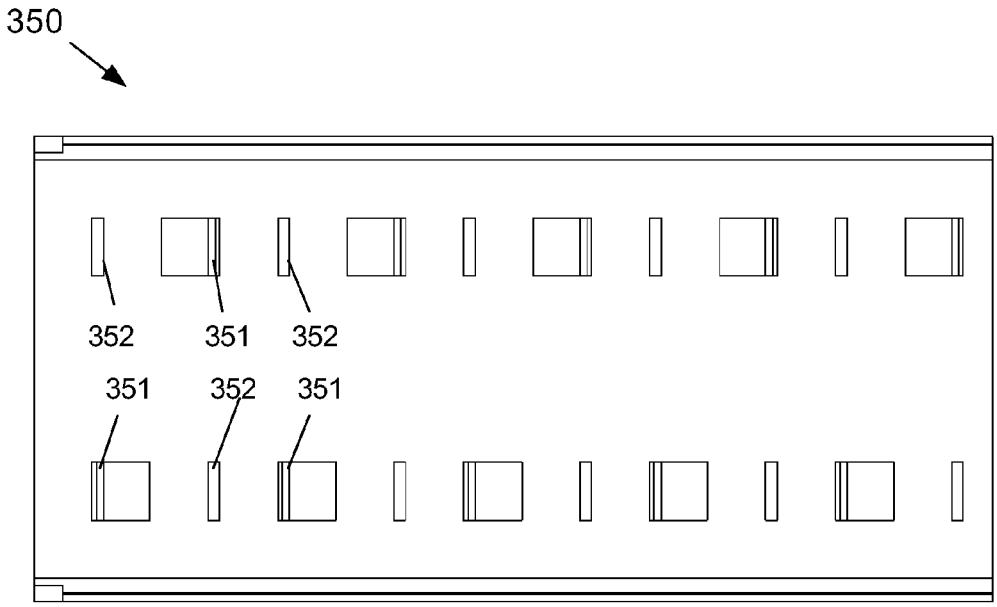
FIGS. 3E-3H respectively depict front, right side, top and isometric view of an exemplary alternative embodiment of a coupling mechanism for a beam and/or a truss beam according to the subject matter disclosed herein.
Figure 3F:
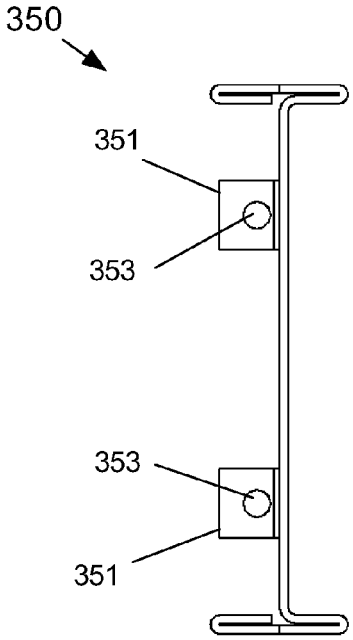
Figure 3G:
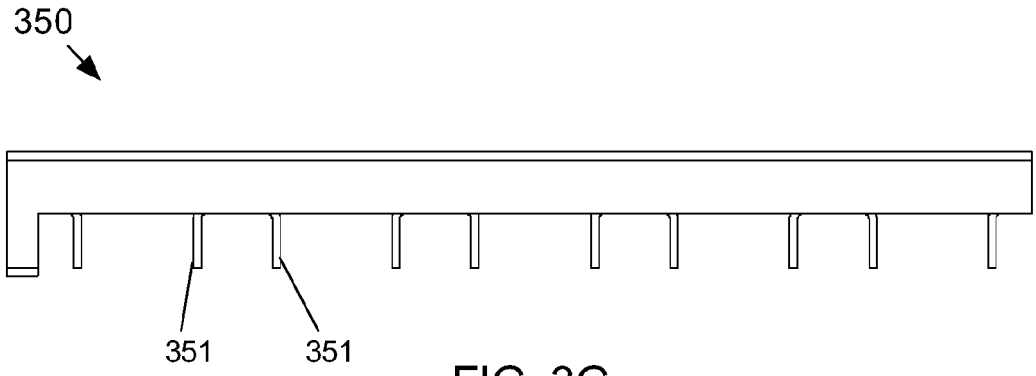
Figure 3H:
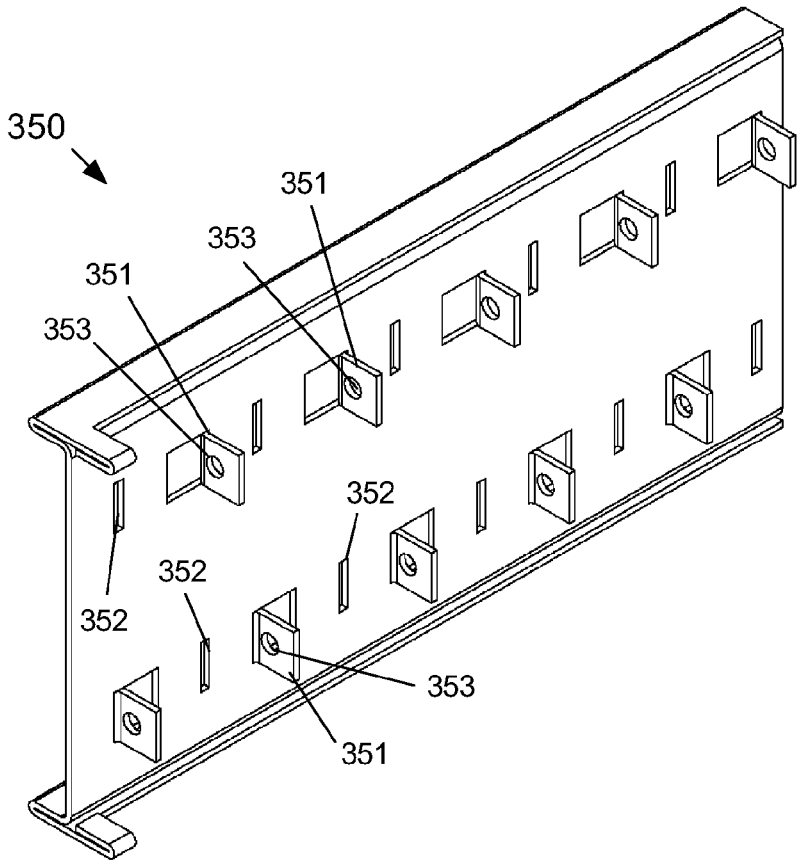

FIG. 2Z shows a side view of an exemplary embodiment of a lower leg beam member 105*a* according to the subject matter disclosed herein. Lower leg beam member 105*a* comprises a first end 263, a middle portion 264 and a second end 265. In one exemplary embodiment, middle portion 264 comprises at least one aperture 266. In another exemplary embodiment, middle portion 264 comprises no apertures 266. In yet another exemplary embodiment, middle portion 264 comprises at least one aperture of a type that is different from an aperture 266. One benefit of aperture 264 is weight reduction of lower leg beam member 105*a*. Each aperture 266 comprises a bent edge 267 that can provide strengthening and increased rigidity for lower leg beam member 105*a*. Bent edge 267 of an aperture 266 is better seen in FIG. 2AD. Lower leg beam member 105*b* comprises a cross-section shape that is similar to the cross-sectional shape of ridge beam member 101*a*. FIG. 2AA shows that first end 263 of lower leg beam member 105*a* comprises protrusion members 268 that mate with slots 251 in a lower leg member 104*b* (FIG. 2V), and a locking member 269 that can be used for providing a locking mechanism when lower leg beam member 105*a* is assembled as part of structure 100. While FIG. 2AA shows only two protrusion members 268, it should be understood that lower leg beam member 105*a* could comprise any number of protrusion members 268.

FIG. 2AB shows that second end 265 comprises a coupling mechanism or lap joint 270. Coupling mechanism 270 comprises protrusion members 271 formed in apertures 272, a protrusion member 273 formed in aperture 274, and apertures 275. A lower leg beam member 105*b* is configured similar to a lower leg beam member 105*a*. Coupling mechanism 270 mechanically couples a lower leg beam member 105*a* to a coupling mechanism 270 of a lower leg beam member 105*b* to form a lower leg beam 105 in a manner similar to that shown in FIG. 2E.

FIG. 2AC shows a lower leg beam member 105*b* assembled with a lower leg member 104*b* at a corner of a structure 100. FIG. 2AD shows a lower leg beam member 105*b* assembled with a lower leg member 104*b* and a lower leg beam member 105*a* at a junction of two sections of a structure 100.

FIGS. 3A-3D respectively depict front, right side, top and isometric view of an exemplary alternative embodiment of a coupling mechanism 300 for a beam and/or a truss beam according to the subject matter disclosed herein. Coupling mechanism 300 corresponds to coupling mechanisms 208 (FIG. 2C), 225 (FIG. 2H), 238 (FIG. 2M), 259 (FIG. 2Y) and 270 (FIG. 2AB). It should be understood that only the coupling mechanism portion of a beam or truss beam is depicted in FIGS. 3A-3D and that the beam would project to the left in FIGS. 3A, 3C and 3D. Coupling mechanism 300 comprises barrel-side members 301-304. Barrel-side member 301 and 304 of a first beam (or truss beam) respectively engage with corresponding barrel-side members 304 and 301 of a second beam (or truss beam). Similarly, barrel-side member 302 and 303 of the first beam (or truss beam) respectively engage with corresponding barrel-side members 303 and 302 of the second beam (or truss beam). When engaged, the corresponding barrel-side members form a cylindrical in which a pin (not shown) is inserted, thereby fastening the engagement. It should be understood that other exemplary embodiments of this alternative embodiment of a coupling mechanism could comprise different numbers of barrel-side members that engage with corresponding barrel-side members. It should also be understood that while barrel-side members 301-304 are depicted as comprising a semi-circular cross-sectional shape, alternative embodiments of barrel-side members could have different cross-sectional shapes.

FIGS. 3E-3H respectively depict front, right side, top and isometric view of an exemplary alternative embodiment of a coupling mechanism 350 for a beam and/or a truss beam according to the subject matter disclosed herein. Coupling mechanism 300 corresponds to coupling mechanisms 208 (FIG. 2C), 225 (FIG. 2H), 238 (FIG. 2M), 259 (FIG. 2Y) and 270 (FIG. 2AB). It should be understood that only the coupling mechanism portion of a beam or truss beam is depicted in FIGS. 3E-3H and that the beam would project to the left in FIGS. 3E, 3G and 3H. Coupling mechanism 350 comprises a plurality of protrusion members 351 and a plurality of apertures 352, of which only a few of each are indicated in FIGS. 3E-3H for clarity. Each protrusion member 351 comprises an aperture 353. Each protrusion member 351 of a first beam (or truss beam) engages with a corresponding aperture 352 of a second beam (or truss beam). Similarly, each protrusion member 351 of the second beam (or truss beam) engages with a corresponding aperture 352 of the first beam (or truss beam). When engaged, a pin member (not shown) is passed through apertures 253 of a line of protrusion members 351, thereby fastening the engagement. It should be understood that other exemplary embodiments of this alternative embodiment of a coupling mechanism could comprise different numbers of protrusion members and corresponding apertures. It should also be understood that while protrusion members 351 are depicted as generally square in shape, other shapes could be used.

FIGS. 4A-4D depicts exemplary alternative bracing mechanism for bracing an exemplary structure 100. In each of FIGS. 4A-4D, sides 401 represent adjacent beams, truss beams and/or legs of an exemplary structure. For example, top side 401 could represent a ridge beam 101, left and right sides 401 could represent truss beams 102, and bottom side 401 could represent an upper leg beam 103. As another example, top side 401 could represent an upper leg beam 103, left and right sides 401 could represent truss beams 102, and bottom side 401 could represent a lower leg beam 105.

Figure 4A:
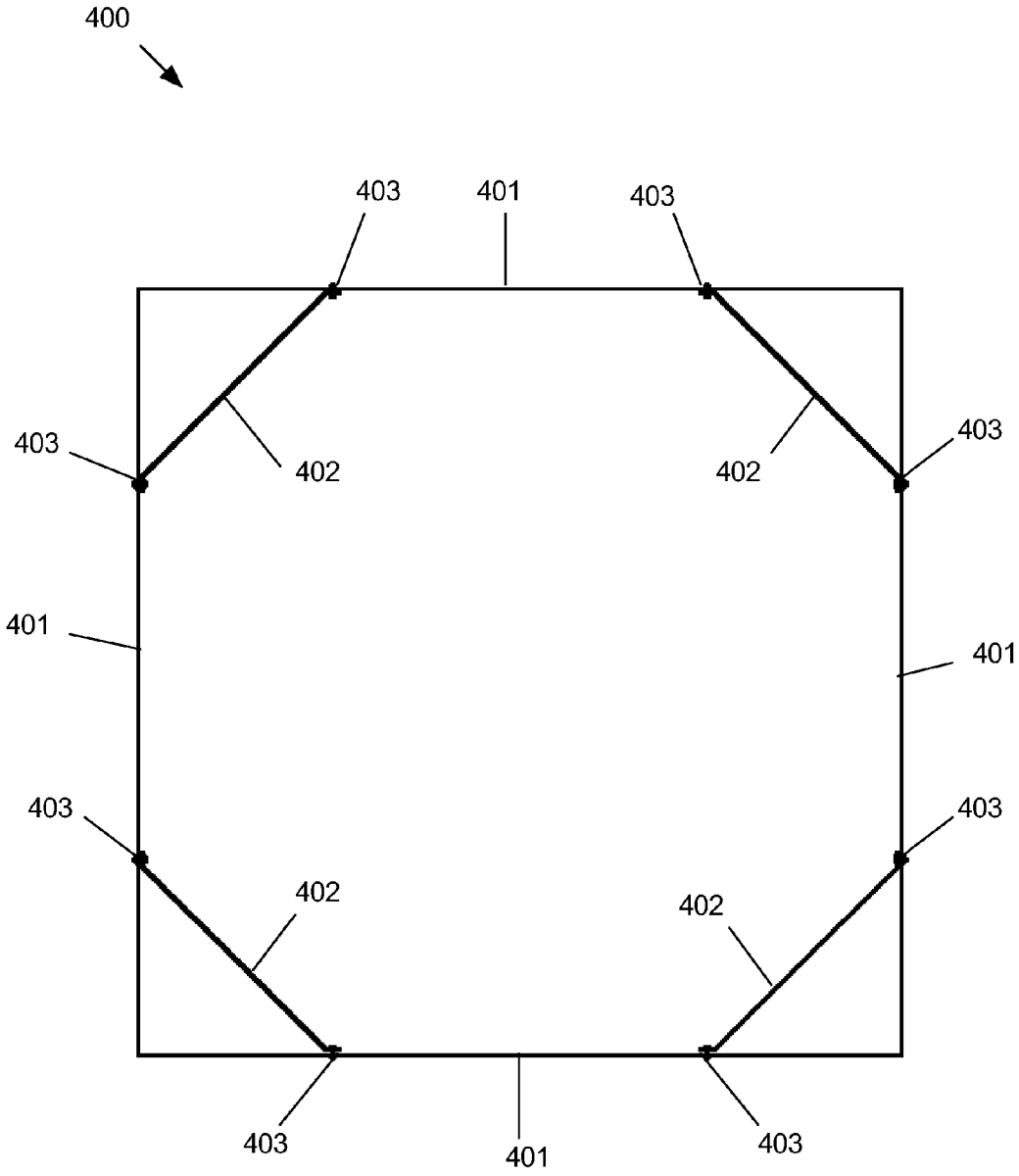
FIGS. 4A-4D respectively depict exemplary alternative bracing techniques for bracing an exemplary structure according to the subject matter disclosed herein.

FIG. 4A, in particular, depicts a bent-member corner-bracing mechanism 400 according to the subject matter disclosed herein. Mechanism 400 comprises bentmembers 402 positioned in each corner formed by adjacent sides 401. Fastening members 403, such as bolts and nuts, and/or pin and pins with cotter pins, fasten the end of each bent member 402 to a side 401 through an aperture in the side in proximity to a corner. Bent members 402 and fastening members 403 should be selected to have sufficient strength and durability for the stresses and strains that an exemplary structure is designed to experience.

Figure 4B:
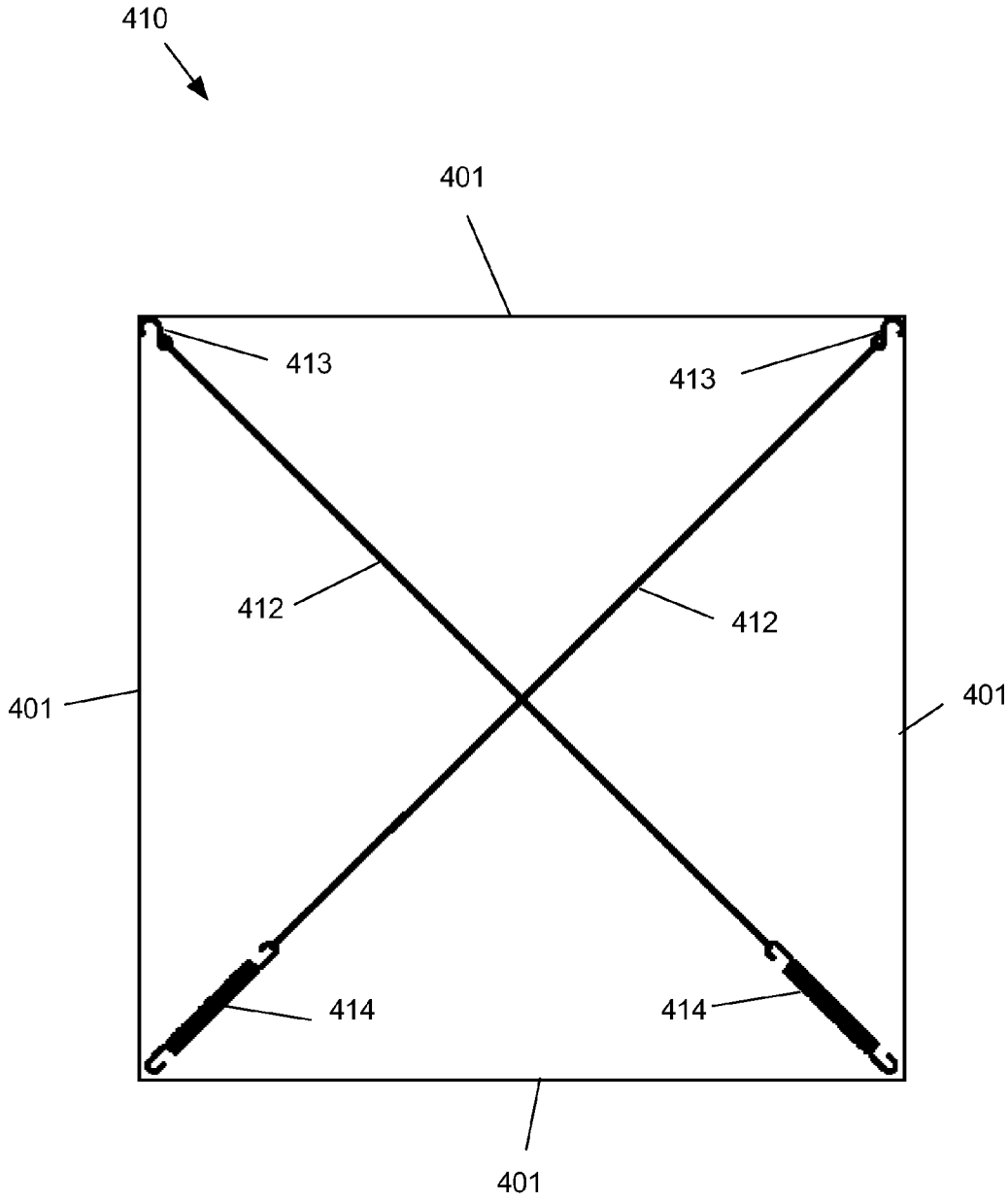

FIG. 4B depicts a diagonal spring cable bracing mechanism 410. Mechanism 410 comprises cable members that extend between opposite corners formed by adjacent sides 401 similar to the manner depicted in FIGS. 1A, 1B and 1D using cable assemblies 106. A cable member 412 comprises, for example, a cable, a rope, a strap or a chain that is coupled in a well-known manner to an attachment member 413 at one end and a tension-forming member 414 at the other end. Attachment member 413 could comprise a nut and bolt or a hook member that engages an aperture at the corner of two adjacent sides 401. Tension-forming member 414 could be, for example, a spring or a turn buckle, and engages an aperture at the opposite corner formed by two adjacent sides. A cable member 412, an attachment member 413 and a tension-forming member 414 should have sufficient strength and durability for the stresses and strains that an exemplary structure is designed to experience. While FIG. 4B depicts mechanism 410 comprising cable members that extend between opposite corners of a section, it should be understood that a cable member could be coupled to a side 401 near a corner formed by adjacent sides such that the cable member effectively extends in a diagonal manner from the corner.

Figure 4C:
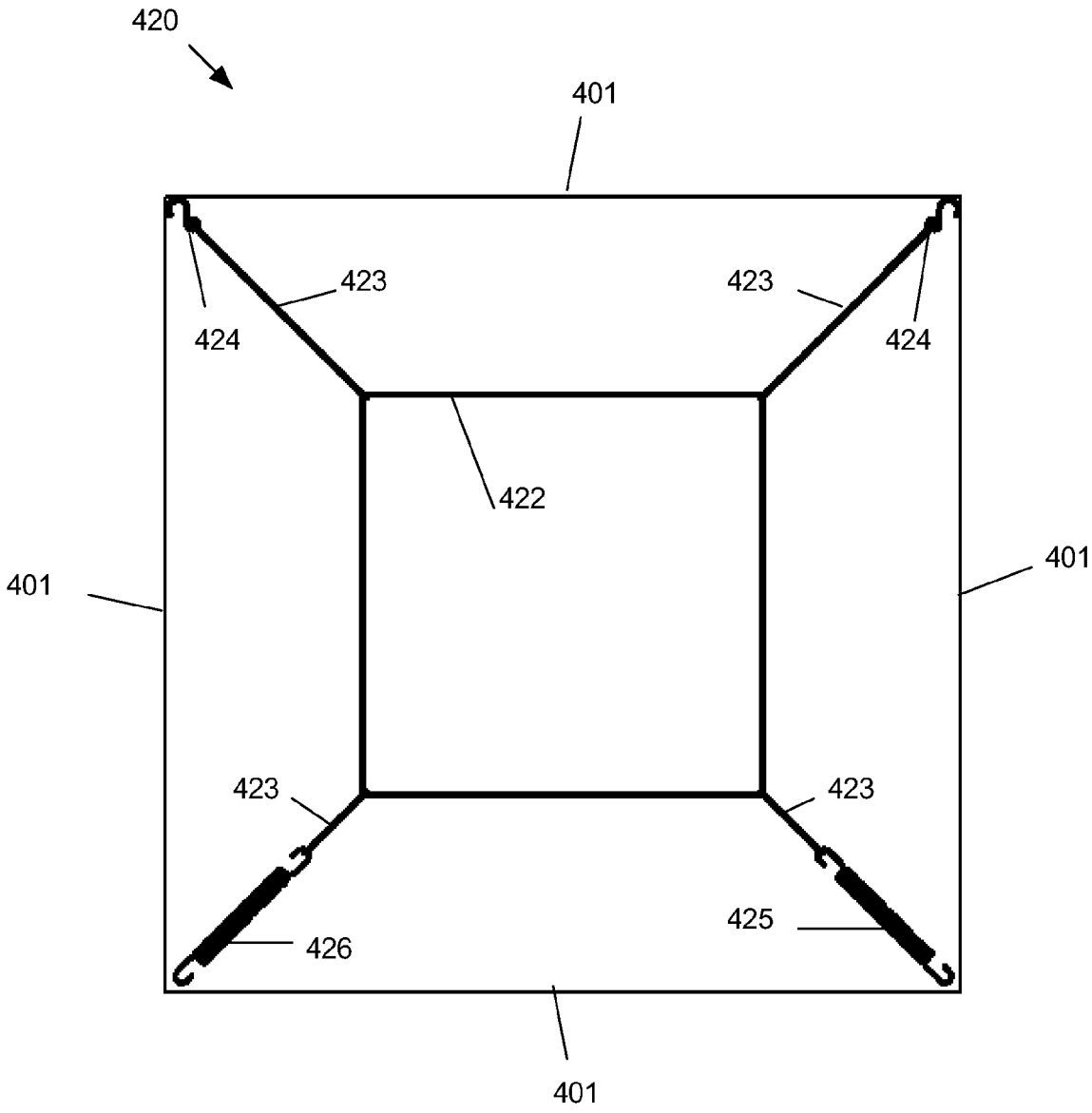

FIG. 4C depicts an exemplary cable ring with diagonal spring cables mechanism 420. Mechanism 420 comprises a ring member 422, cable members 423, attachment members 424 and tension-forming members 425. Ring member 422 could be rigidly shaped or could be flexible. Additionally, while ring member 422 is depicted as a square, ring member 422 could be any shape that is suitable for bracing with diagonal spring cables. A cable member 423 comprises, for example, a cable, a rope, a strap or a chain that is coupled in a well-known manner to an attachment member 424 or a tension-forming member 425. An attachment member 424 could comprise a nut and bolt or a hook member that engages an aperture at the corner. A tension-forming member 435 could be, for example, a spring or a turn buckle, and engages an aperture at a corner formed by adjacent sides 401. While FIG. 4C depicts two attachment members 424 and two tension-forming members 425, it should be understood that each cable member could comprise an attachment member 424 or a tension-forming member 425. Ring member 422, cable members 423, attachment member 424 and tension-forming member 425 should have sufficient strength and durability for the stresses and strains that an exemplary structure is designed to experience. While FIG. 4C depicts mechanism 420 comprising cable members that extend from opposite corners of a section, it should be understood that a cable member could be coupled to a side 401 near a corner formed by adjacent sides such that the cable member effectively extends in a diagonal manner from the corner.

Figure 4D:
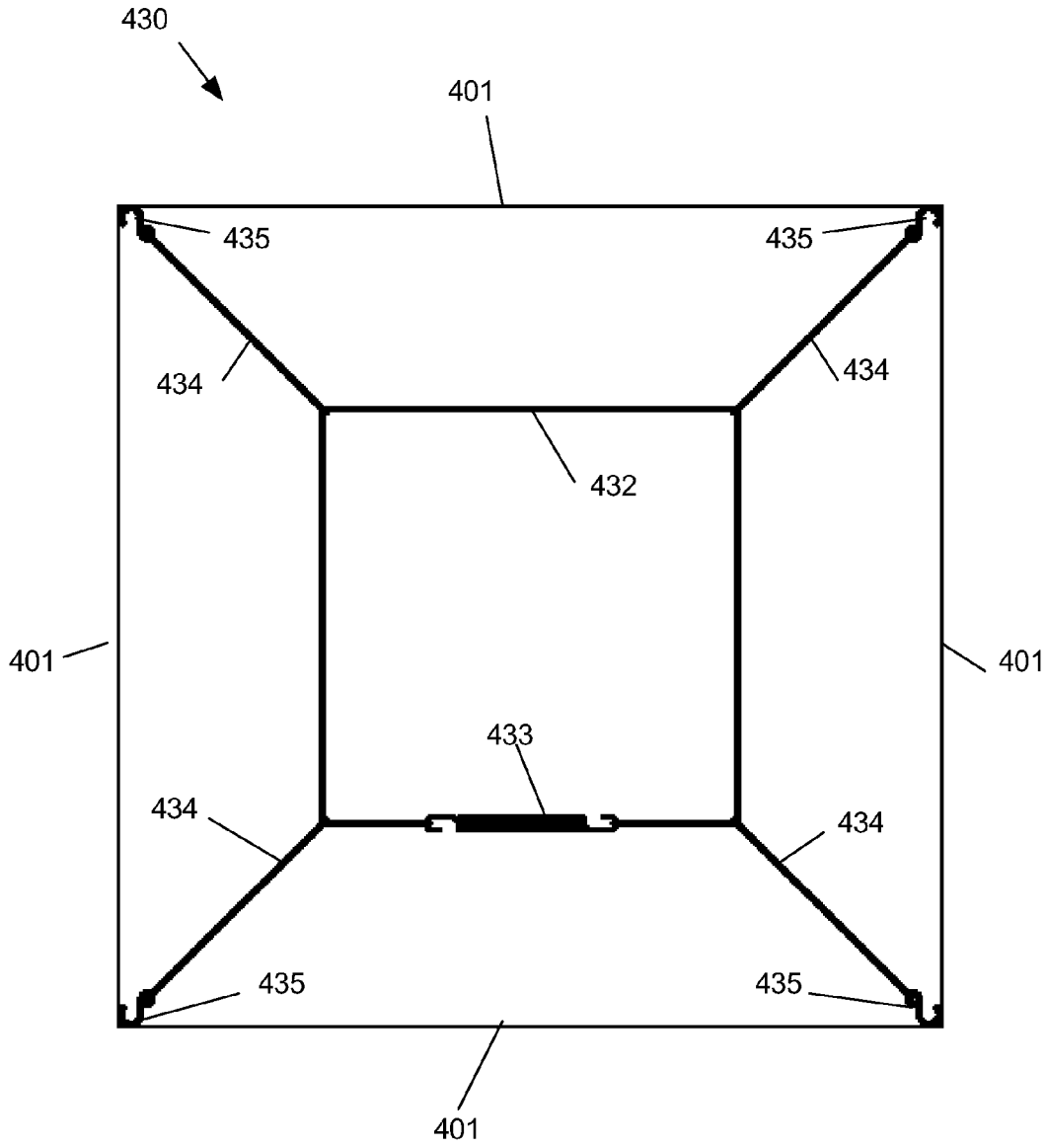

FIG. 4D depicts a spring-cable ring with diagonal cables bracing mechanism 430. Mechanism 430 comprises a spring-cable ring 432, a tension-forming member 433, cable members 434 and attachment members 435. Spring-cable ring 432 is attached to tension-forming member 433 in a well-known manner. A cable member 434 comprises, for example, a cable, a rope, a strap or a chain, that is attached to spring-cable ring 432 in a well-known manner and is attached to an attachment member 435 in well-known manner. An attachment member 435 could comprise a nut and bolt or a hook member that engages an aperture at a corner formed by two adjacent sides 401. Spring-cable ring member 432, spring-member 433, cable members 434 and attachment member 435 should have sufficient strength and durability for the stresses and strains that an exemplary structure is designed to experience. While FIG. 4D depicts mechanism 430 comprising cable members that extends from opposite corners of a section, it should be understood that a cable member could be coupled to a side 401 near a corner formed by adjacent sides such that the cable member effectively extends substantially in a diagonal manner from the corner.

Locking members 207 (FIG. 2B), 237 (FIG. 2L), 258 (FIG. 2X) and 269 (FIG. 2AA) can be used for providing a locking mechanism when the member with which the locking member is associated is assembled as part of a structure 100. Referring to FIG. 2O, a locking member operates by placing an object, such as the blade of a screwdriver, into space 276 and rotating the inserted blade so that portion 277 bends in the direction indicated by 278 into the aperture of upper leg member 104*a* indicated at 279 so that portion 277 interferes with movement of upper leg beam member 103*a* in a vertical direction.

Although protrusion members 206 (FIG. 2B), 236 (FIG. 2L), 257 (FIG. 2X) and 268 (FIG. 2AA) are depicted as having a panhandle shape, it should be understood that protrusion members 206, 236, 257 and 268 could comprise an alternative shape that engages a corresponding aperture in a mating manner. For example, an alternative shape could be a cylindrically shaped protrusion having a head that engages and is held by an aperture having a corresponding shape. Further, the number of protrusion members can vary from exemplary embodiment to exemplary embodiment. Even further, it should be understood that the number of any of apertures 204 (FIG. 2A), 219 (FIG. 2F), 234 (FIG. 2K), 255 (FIG. 2W) and 266 (FIG. 2Z) could be different from the exemplary number shown. Additionally, it should be understood that the size and shape of apertures of any of 204, 219, 234, 255 and 266 could be different from the exemplary sizes and shapes shown. Further still, it should be understood that number, size and shape of the keyhole apertures 246, 247 and/or 248 (FIG. 2S) could be different from the exemplary number, size and shapes shown.

While exemplary structure 100 has been depicted as comprising beams, truss beams and legs formed by two members, it should be understood that each beam, truss beam and leg could be formed as a single unit or from a plurality of members. Further, it should be understood that exemplary structure 100 could be anchored in a well-known manner using, for example, one or more cables, ropes, straps, chains or the like fastened between structure 100 and a stationary object, such as the ground.

Although the foregoing disclosed subject matter has been described in some detail for purposes of clarity of understanding, it will be apparent that certain changes and modifications may be practiced that are within the scope of the appended claims. Accordingly, the present embodiments are to be considered as illustrative and not restrictive, and the subject matter disclosed herein is not to be limited to the details given herein, but may be modified within the scope and equivalents of the appended claims.

What is claimed is:

1. A structure, comprising:

at least one horizontal beam comprising a first end and a second end, the first end of a first horizontal beam comprising at least one protrusion member that projects in a direction that is substantially parallel to a plane of the first horizontal beam; and a plurality of truss beams, a first truss beam and a second truss beam each comprising a first end and a second end, the first end of the first and second truss beams comprising a plurality of apertures and at least one protrusion member that projects in a direction that is substantially parallel to a plane of the truss beam, at least one protrusion member of the first end of a first truss beam and the first end of the second truss beam being respectively capable of engaging a corresponding aperture of the first end of the second truss beam and a corresponding aperture of the first end of the first truss beam to form a first peak section, and at least one aperture of the first end of each of the first and second truss beams being capable of being aligned and when aligned being capable of receiving a corresponding protrusion member of the first end of a first horizontal beam.

2. The structure according to claim 1, wherein the first end of a second horizontal beam comprises at least one protrusion member that projects in a direction that is substantially parallel to a plane of the second horizontal beam, the structure further comprising a leg capable of engaging the second end of a truss beam, the leg comprising an aperture capable of receiving a corresponding protrusion member of the first end of a second horizontal beam.

3. The structure according to claim 2, wherein the leg comprises a length that is selectably adjustable.

4. The structure according to claim 3, wherein the leg comprises a first end and a second end, the structure further comprising a bracing mechanism coupled to and extending in a diagonal manner from the first end of the leg, or the second end of the leg, or a combination thereof.

5. The structure according to claim 3, wherein the second end of the first horizontal beam comprises at least one protrusion member that projects in a direction that is substantially parallel to a plane of the horizontal beam, the structure further comprising:

a third truss beam and a fourth truss beam each comprising a first end and a second end, the first end of the third and fourth truss beams comprising a plurality of apertures and at least one protrusion member that projects in a direction that is substantially parallel to a plane of the truss beam, at least one protrusion member of the first end of the third truss beam and the first end of a fourth truss beam being respectively capable of engaging a corresponding aperture of the first end of the fourth truss beam and a corresponding aperture of the first end of the third truss beam to form a second peak section, and at least one aperture of the first end of each of the third and fourth truss beams being capable of being aligned and when aligned being capable of receiving a corresponding protrusion member of the second end of the first horizontal beam; and a bracing mechanism coupled to and extending in a diagonal manner from the first end or the second end, or a combination thereof, of the first truss beam or the second truss beam, or a combination thereof.

6. The structure according to claim 1, further comprising a leg capable of engaging the second end of a truss beam, the leg comprising a length that is selectably adjustable.

7. The structure according to claim 6, wherein the leg comprises a first end and a second end, the structure further comprising a bracing mechanism coupled to and extending in a diagonal manner from the first end of the leg, or the second end of the leg, or a combination thereof.

8. The structure according to claim 6, wherein the second end of the first horizontal beam comprises at least one protrusion member that projects in a direction that is substantially parallel to a plane of the horizontal beam, the structure further comprising:

a third truss beam and a fourth truss beam each comprising a first end and a second end, the first end of the third and fourth truss beams comprising a plurality of apertures and at least one protrusion member that projects in a direction that is substantially parallel to a plane of the truss beam, at least one protrusion member of the first end of the third truss beam and the first end of a fourth truss beam being respectively capable of engaging a corresponding aperture of the first end of the fourth truss beam and a corresponding aperture of the first end of the third truss beam to form a second peak section, and at least one aperture of the first end of each of the third and fourth truss beams being capable of being aligned and when aligned being capable of receiving a corresponding protrusion member of the second end of the first horizontal beam; and a bracing mechanism coupled to and extending in a diagonal manner from the first end or the second end, or a combination thereof, of the first truss beam or the second truss beam, or a combination thereof.

9. The structure according to claim 1, further comprising:

a leg comprises a first end and a second end, the first end engaging the second end of a truss beam; and a bracing mechanism coupled to and extending in a diagonal manner from the first end of the leg, or the second end of the leg, or a combination thereof.

10. The structure according to claim 1, wherein the second end of the first horizontal beam comprises at least one protrusion member that projects in a direction that is substantially parallel to a plane of the horizontal beam, the structure further comprising:

a third truss beam and a fourth truss beam each comprising a first end and a second end, the first end of the third and fourth truss beams comprising a plurality of apertures and at least one protrusion member that projects in a direction that is substantially parallel to a plane of the truss beam, at least one protrusion member of the first end of the third truss beam and the first end of a fourth truss beam being respectively capable of engaging a corresponding aperture of the first end of the fourth truss beam and a corresponding aperture of the first end of the third truss beam to form a second peak section, and at least one aperture of the first end of each of the third and fourth truss beams being capable of being aligned and when aligned being capable of receiving a corresponding protrusion member of the second end of the first horizontal beam; and a bracing mechanism coupled to and extending in a diagonal manner from the first end of a truss beam, or the second end of a truss beam, or a combination thereof.

11. A structure, comprising:

at least one horizontal beam comprising a first end and a second end, the first end of a first horizontal beam comprising at least one protrusion member that projects in a direction that is substantially parallel to a plane of the first horizontal beam;

a plurality of truss beams, a first truss beam and a second truss beam each comprising a first end and a second end, the first end of the first and second truss beams comprising a plurality of apertures and at least one protrusion member that projects in a direction that is substantially parallel to a plane of the truss beam, at least one protrusion member of the first end of a first truss beam and the first end of the second truss beam being respectively capable of engaging a corresponding aperture of the first end of the second truss beam and a corresponding aperture of the first end of the first truss beam to form a first peak section; and a leg capable of engaging the second end of a truss beam, the leg comprising an aperture capable of receiving a corresponding protrusion member of the first end of the first horizontal beam.

12. The structure according to claim 11, wherein the first end of a second horizontal beam comprises at least one protrusion member that projects in a direction that is substantially parallel to a plane of the second horizontal beam, and wherein at least one aperture of the first end of each of the first and second truss beams are capable of being aligned and when aligned are capable of receiving a corresponding protrusion member of the first end of the second horizontal beam.

13. The structure according to claim 11, wherein the leg comprises a length that is selectably adjustable.

14. The structure according to claim 13, wherein the leg comprises a first end and a second end, the structure further comprising a bracing mechanism coupled to and extending in a diagonal manner from the first end of the first let, or the second end of the first leg, or a combination thereof.

15. The structure according to claim 13, wherein the second end of the second horizontal beam comprises at least one protrusion member that projects in a direction that is substantially parallel to a plane of the horizontal beam, the structure further comprising:

a third truss beam and a fourth truss beam each comprising a first end and a second end, the first end of the third and fourth truss beams comprising a plurality of apertures and at least one protrusion member that projects in a direction that is substantially parallel to a plane of the truss beam, at least one protrusion member of the first end of the third truss beam and the first end of a fourth truss beam being respectively capable of engaging a corresponding aperture of the first end of the fourth truss beam and a corresponding aperture of the first end of the third truss beam to form a second peak section, and at least one aperture of the first end of each of the third and fourth truss beams being capable of being aligned and when aligned being capable of receiving a corresponding protrusion member of the second end of the second horizontal beam; and a bracing mechanism coupled to and extending in a diagonal manner from the first end or the second end, or a combination thereof, of the first truss beam or the second truss beam, or a combination thereof.

16. The structure according to claim 11, wherein the leg comprises a first end and a second end, the structure further comprising a bracing mechanism coupled to and extending in a diagonal manner from the first end of the leg, or the second end of the leg, or a combination thereof.

17. The structure according to claim 11, wherein a second horizontal beam comprises a first end and a second end, the first end of a second horizontal beam comprising at least one protrusion member that projects in a direction that is substantially parallel to a plane of the second horizontal beam, and wherein at least one aperture of the first end of each of the first and second truss beams being capable of being aligned and when aligned being capable of receiving a corresponding protrusion member of the first end of the second horizontal beam, the structure further comprising a bracing mechanism coupled to and extending in a diagonal manner from the first end or the second end, or a combination thereof, of the first truss beam or the second truss beam, or a combination thereof.

18. A structure, comprising:

at least one horizontal beam comprising a first end and a second end, the first end of a first horizontal beam comprising at least one protrusion member that projects in a direction that is substantially parallel to a plane of the first horizontal beam;

a plurality of truss beams, a first truss beam and a second truss beam each comprising a first end and a second end, the first end of the first and second truss beams comprising a plurality of apertures and at least one protrusion member that projects in a direction that is substantially parallel to a plane of the truss beam, at least one protrusion member of the first end of a first truss beam and the first end of the second truss beam being respectively capable of engaging a corresponding aperture of the first end of the second truss beam and a corresponding aperture of the first end of the first truss beam to form a first peak section, at least one aperture of the first end of each of the first and second truss beams being capable of being aligned and when aligned being capable of receiving a corresponding protrusion member of the first end of the first horizontal beam; and a bracing mechanism coupled to and extending in a diagonal manner from the first end of a truss beam, or the second end of a truss beam, or a combination thereof.

* * * * *